US012637746B2

(12) United States Patent
Haga

(10) Patent No.: US 12,637,746 B2
(45) Date of Patent: May 26, 2026

(54) STEEL SHEET FOR HOT STAMPING AND HOT STAMPED PRODUCT

(71) Applicant: NIPPON STEEL CORPORATION, Tokyo (JP)

(72) Inventor: Jun Haga, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 407 days.

(21) Appl. No.: 18/288,478

(22) PCT Filed: May 13, 2022

(86) PCT No.: PCT/JP2022/020249
§ 371 (c)(1),
(2) Date: Oct. 26, 2023

(87) PCT Pub. No.: WO2022/239866
PCT Pub. Date: Nov. 17, 2022

(65) Prior Publication Data

US 2024/0376580 A1 Nov. 14, 2024

(30) Foreign Application Priority Data

May 13, 2021 (JP) ..... 2021-081622

(51) Int. Cl.
*C22C 38/32* (2006.01)
*B21D 22/02* (2006.01)
(Continued)

(52) U.S. Cl.
CPC ..... *C22C 38/32* (2013.01); *B21D 22/022* (2013.01); *C21D 1/84* (2013.01); *C21D 6/001* (2013.01);
(Continued)

(58) Field of Classification Search
None
See application file for complete search history.

(56) References Cited

U.S. PATENT DOCUMENTS 11,365,465 B2 * 6/2022 Yabu ..... C21D 9/46
2020/0071799 A1 * 3/2020 Takeda ..... B32B 15/011
(Continued)

FOREIGN PATENT DOCUMENTS

JP 2002-102980 A 4/2002
JP 2006-152427 A 6/2006
(Continued)

*Primary Examiner* — Seth Dumbris
(74) *Attorney, Agent, or Firm* — Birch, Stewart, Kolasch & Birch, LLP

(57) ABSTRACT

A steel sheet for hot stamping has a predetermined chemical composition, in which, when a Mo content of the steel sheet is measured by line analysis using an electron probe micro-analyzer (EPMA) in a range of 0.05 mm in a sheet thickness direction, in which a ¼ depth position of a sheet thickness of the steel sheet from a surface of the steel sheet is a center, a maximum value of the Mo content, a minimum value of the Mo content, and an average value of the Mo content satisfy $([Mo]_{MAX}-[Mo]_{MIN})/[Mo]_{AVE}<0.50$, and a standard deviation of a Vickers hardness in a region of 0.3 mm in the sheet thickness direction and 0.6 mm in a direction perpendicular to the sheet thickness direction, in which the ¼ depth position of the sheet thickness of the steel sheet from the surface of the steel sheet is a center, is 20 (Hv) or less.

6 Claims, 4 Drawing Sheets

(51) Int. Cl.

| | |
|---|---|
| ***C21D 1/84*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C21D 8/0278*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/22*** | (2006.01) |
| ***C22C 38/26*** | (2006.01) |
| ***C22C 38/28*** | (2006.01) |

(52) U.S. Cl.

CPC ..... *C21D 6/002* (2013.01); *C21D 6/005* (2013.01); *C21D 6/008* (2013.01); *C21D 8/02* (2013.01); *C21D 8/0226* (2013.01); *C21D 8/0236* (2013.01); *C21D 8/0263* (2013.01); *C21D 8/0278* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/22* (2013.01); *C22C 38/26* (2013.01); *C22C 38/28* (2013.01); *C21D 2211/008* (2013.01)

(56) References Cited

U.S. PATENT DOCUMENTS

| | | | | |
|---|---|---|---|---|
| 2020/0131596 | A1* | 4/2020 | Takashima | C21D 1/18 |
| 2022/0118741 | A1* | 4/2022 | Takashima | B32B 15/015 |

FOREIGN PATENT DOCUMENTS

| | | | |
|---|---|---|---|
| JP | 2010-65294 | A | 3/2010 |
| JP | 2010-65295 | A | 3/2010 |

* cited by examiner

STEEL SHEET FOR HOT STAMPING AND HOT STAMPED PRODUCT

TECHNICAL FIELD OF THE INVENTION

The present invention relates to a steel sheet for hot stamping and a hot stamped product.

Priority is claimed on Japanese Patent Application No. 2021-081622, filed May 13, 2021, the content of which is incorporated herein by reference.

RELATED ART

Today, as industrial technology fields are highly divided, materials used in each technology field require special and advanced performance. For example, steel sheets for a vehicle are required to have high strength in order to improve fuel efficiency by reducing a weight of a vehicle body in consideration of the global environment. In a case where a high strength steel sheet is applied to the vehicle body of a vehicle, a desired strength can be imparted to the vehicle body while reducing a sheet thickness of the steel sheet and reducing the weight of the vehicle body.

However, in press forming, which is a step for forming a vehicle body member of a vehicle, cracks and wrinkles are more likely to occur as a thickness of a steel sheet used decreases. Therefore, the steel sheet for a vehicle also requires excellent press formability.

Securing the press formability and high-strengthening of the steel sheet are contradictory elements, and it is difficult to satisfy these properties simultaneously. In addition, when a high strength steel sheet is press-formed and a member is taken out of a die, a shape of the member is greatly changed due to springback, so that it is difficult to secure dimensional accuracy of the member. As described above, it is not easy to manufacture a high strength vehicle body member by press forming.

Hitherto, as a method of manufacturing an ultrahigh-strength vehicle body member, for example, as disclosed in Patent Document 1, a technique for press-forming a heated steel sheet using a low-temperature press die has been proposed. This technique is called hot stamping, hot pressing, or the like, and in this technique, a steel sheet which is heated to a high temperature and is thus in a soft state is press-formed, so that a member having a complex shape can be manufactured with high dimensional accuracy. In addition, since the steel sheet is rapidly cooled by contact with the die, it is possible to significantly increase strength by quenching at the same time as press forming. For example, Patent Document 1 describes that a member having a tensile strength of 1,400 MPa or more is obtained by performing hot stamping on a steel sheet having a tensile strength of 500 to 600 MPa.

As a technique for manufacturing a hot stamped member having higher strength, Patent Document 2 discloses a hot stamped member having a tensile strength of 1,770 to 1,940 MPa and a manufacturing method thereof, and Patent Document 3 discloses a hot stamped member having a tensile strength of 1,960 to 2,130 MPa hot stamped member and a manufacturing method thereof. In the methods described in Patent Documents 2 and 3, a steel sheet for hot stamping is hot-stamped after being heated to a ferrite/austenite dual phase region to cause a metallographic microstructure of the hot stamped member to have a composite structure of ferrite and martensite with an average grain size of 7 μm or less, thereby increasing ductility of the steel sheet including the member. However, according to an examination by the present inventors, it was found that in a hot stamped member having a composite structure of ferrite and martensite, when the member is deformed in a collision, there are cases where cracks originating from ferrite occur in an early stage of deformation, so that it is particularly difficult for a member having a tensile strength more than 2,300 MPa to secure collision safety of a vehicle body.

Patent Document 4 discloses a technique for manufacturing a hot stamped member having excellent toughness and a tensile strength of 1,800 MPa or more. In the method described in Patent Document 4, a steel sheet for hot stamping is hot-stamped after being heated in a low temperature range of austenite, and is relatively slowly cooled in a temperature range of an Ms point or lower to form a metallographic microstructure of tempered martensite in which a prior austenite grain size is 10 μm or less, thereby increasing the toughness of the member. The technique disclosed in Patent Document 4 is excellent in that it is possible to obtain a 1,800 MPa-grade hot stamped member in which cracking does not occur even in a low temperature impact test. However, there is no description about a member having a tensile strength of 2,300 MPa or more. According to an examination by the present inventors, it was found that even in a hot stamped member having a single-phase structure of tempered martensite as described in Patent Document 4, when the tensile strength is increased to 2,300 MPa or more, a local fluctuation in hardness occurs inside the member, and cracking occurs in an early stage of deformation in a collision, resulting in insufficient collision resistance.

PRIOR ART DOCUMENT

Patent Document

[Patent Document 1] Japanese Unexamined Patent Application, First Publication No. 2002-102980
[Patent Document 2] Japanese Unexamined Patent Application, First Publication No. 2010-65294
[Patent Document 3] Japanese Unexamined Patent Application, First Publication No. 2010-65295
[Patent Document 4] Japanese Unexamined Patent Application, First Publication No. 2006-152427

DISCLOSURE OF THE INVENTION

Problems to be Solved by the Invention

As described above, it has been difficult in the related art to manufacture a member having a tensile strength of 2,300 MPa or more, particularly, a hot stamped member (hot stamped product) having excellent collision resistance and a tensile strength of 2,300 MPa or more by hot stamping.

To solve the above-described problems, an object of the present invention is to provide a steel sheet for hot stamping suitable as a material for a hot stamped product having excellent collision resistance and a tensile strength of 2,300 MPa or more, and a hot stamped product having excellent collision resistance and a tensile strength of 2,300 MPa or more.

Means for Solving the Problem

The present invention has been made to solve the above-described problems, and the gist of the present invention is the following steel sheet for hot stamping.

[1] A steel sheet for hot stamping according to an aspect of the present invention includes, as a chemical composition, by mass %: C: more than 0.40% and 0.70% or less; Si: less than 2.00%; Mn: 0.01% or more and less than 0.50%; P: 0.200% or less; S: 0.0200% or less; sol. Al: 0.001% to 1.000%; N: 0.0200% or less; Mo: 0.01% or more and less than 0.50%; B: 0.0002% to 0.0200%; Ti: 0% to 0.200%; Nb: 0% to 0.200%; V: 0% to 0.200%; Zr: 0% to 0.200%; Cr: 0% to 2.00%; W: 0% to 2.00%; Cu: 0% to 2.00%; Ni: 0% to 2.00%; Ca: 0% to 0.0100%; Mg: 0% to 0.0100%; REM: 0% to 0.1000%; Bi: 0% to 0.0500%; and a remainder: Fe and impurities, in which, when a Mo content of the steel sheet is measured by line analysis using an electron probe microanalyzer (EPMA) in a range of 0.05 mm in a sheet thickness direction, in which a ¼ depth position of a sheet thickness of the steel sheet from a surface of the steel sheet is a center, a maximum value of the Mo content, a minimum value of the Mo content, and an average value of the Mo content satisfy Expression (i), and a standard deviation of a Vickers hardness in a region of 0.3 mm in the sheet thickness direction and 0.6 mm in a direction perpendicular to the sheet thickness direction, in which the ¼ depth position of the sheet thickness of the steel sheet from the surface of the steel sheet is a center, is 20 (Hv) or less, $$([Mo]_{MAX} - [Mo]_{MIN}/[Mo]_{AVE} < 0.50 \quad \text{(i)}$$

wherein meaning of each symbol in Expression (i) is as follows, $[Mo]_{MAX}$: the maximum value of the Mo content (mass %), $[Mo]_{MIN}$: the minimum value of the Mo content (mass %), and $[Mo]_{AVE}$: the average value of the Mo content (mass %).

[2] In the steel sheet for hot stamping according to [1], the chemical composition may contain, by mass %, one or more selected from: Ti: 0.001% to 0.200%; Nb: 0.001% to 0.200%; V: 0.001% to 0.200%; and Zr: 0.001% to 0.200%.

[3] In the steel sheet for hot stamping according to [1] or [2], the chemical composition may contain, by mass %, one or more selected from: Cr: 0.001% to 2.00%; W: 0.001% to 2.00%; Cu: 0.001% to 2.00%; and Ni: 0.001% to 2.00%.

[4] In the steel sheet for hot stamping according to any one of [1] to [3], the chemical composition may contain, by mass %, one or more selected from: Ca: 0.0001% to 0.0100%; Mg: 0.0001% to 0.0100%; and REM: 0.0001% to 0.1000%.

[5] In the steel sheet for hot stamping according to any one of [1] to [4], the chemical composition may contain, by mass %: Bi: 0.0001% to 0.0500%.

[6] A hot stamped product according to another aspect of the present invention includes: a base steel sheet, in which the base steel sheet includes, as a chemical composition, by mass %, C: more than 0.40% and 0.70% or less, Si: less than 2.00%, Mn: 0.01% or more and less than 0.50c, P: 0.200% or less, S: 0.0200% or less, sol. Al: 0.001% to 1.000%, N: 0.0200% or less, Mo: 0.01% or more and less than 0.50%, B: 0.0002% to 0.0200%, Ti: 0% to 0.200%, N-b: 0% to 0.200%, V: 0% to 0.200%, Zr: 0% to 0.200%, Cr: 0% to 2.00%, W: 0% to 2.00%, Cu: 0% to 2.00%, Ni: 0% to 2.00%, Ca: 0% to 0.0100%, Mg: 0% to 0.0100%, REM: 0% to 0.1000%, Bi: 0% to 0.0500%, and a remainder: Fe and impurities, when a Mo content of the base steel sheet is measured by line analysis using an EPMA in a range of 0.05 mm in a sheet thickness direction, in which a ¼ depth position of a sheet thickness of the base steel sheet from a surface of the base steel sheet is a center, a maximum value of the Mo content, a minimum value of the Mo content, and an average value of the Mo content satisfy Expression (ii), a metallographic microstructure of the base steel sheet contains 90.0% or more of martensite, a standard deviation of a Vickers hardness in a region of 0.3 mm in the sheet thickness direction and 0.6 mm in a direction perpendicular to the sheet thickness direction, in which the ¼ depth position of the sheet thickness of the base steel sheet from the surface of the base steel sheet is a center, is 20 (lv) or less, and a tensile strength of the base steel sheet is 2,300 MPa or more, $$([Mo]_{mMAX} - [Mo]_{mMIN})/[Mo]_{mAVE} < 0.50 \quad \text{(ii)}$$

wherein meaning of each symbol in Expression (ii) is as follows, $[Mo]_{mMAX}$: the maximum value of the Mo content of the base steel sheet (mass %), $[Mo]_{mMin}$: the minimum value of the Mo content of the base steel sheet (mass %), and $[Mo]_{mAVE}$: the average value of the Mo content of the base steel sheet (mass %).

Effects of the Invention

According to the above aspects of the present invention, it is possible to obtain a steel sheet for hot stamping suitable as a material for a hot stamped product having excellent collision resistance and a tensile strength of 2,300 MPa or more, and a hot stamped product having excellent collision resistance and a tensile strength of 2,300 MPa or more.

EMBODIMENTS OF THE INVENTION

Figure 1:
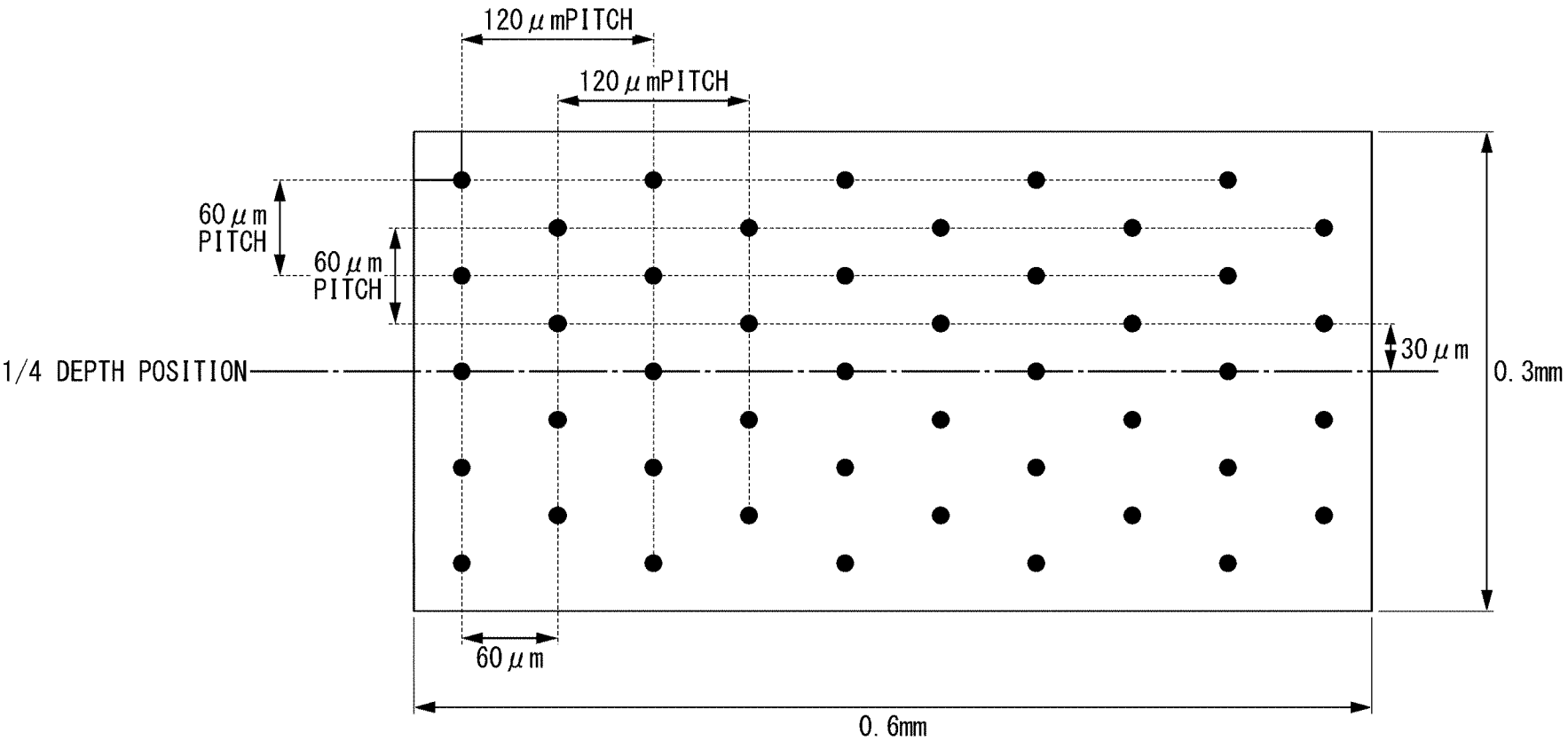
FIG. 1 is a schematic diagram showing hardness measurement positions of a steel sheet for hot stamping and a hot stamped product.

The present inventors intensively studied a method for suppressing the occurrence of cracking during deformation due to a collision in a hot stamped product having a tensile strength of 2,300 MPa or more. In particular, the present inventors intensively studied a method for suppressing the occurrence of cracking during deformation of a hot stamped product due to a collision by controlling a chemical composition and a structure of a steel sheet for hot stamping used in the hot stamped product. As a result, the following findings were obtained.

(A) In a hot stamped product having a tensile strength of 2,300 MPa or more, a local fluctuation in hardness is likely to occur, and when the hot stamped product is deformed, stress concentrates on a portion having low hardness, resulting in the occurrence of cracking in an early stage of the deformation.

(B) By using a steel sheet with a small local fluctuation in Mo concentration as a steel sheet for hot stamping, the occurrence of cracking when the hot stamped product is deformed is suppressed.

The reason for this is not clear, but this is presumably due to the following reasons: (a) in a portion having a low Mo concentration, austenite becomes coarse in a process of heating the steel sheet in a step of performing hot stamping, and a hardness of the hot stamped product tends to be low, and (b) in a portion having a high Mo concentration, austenite is refined in the process of heating the steel sheet and the hardness of the hot stamped product tends to be high.

(C) By reducing a local fluctuation in hardness in the steel sheet for hot stamping, the occurrence of cracking when the hot stamped product is deformed is suppressed.

The reason for this is not clear, but this is presumably due to the following reasons: (a) the localization of soft ferrite in the steel sheet for hot stamping increases the fluctuation in hardness, (b) in a portion having a high ferrite fraction, austenite becomes coarse in the process of heating the steel sheet in the step of performing hot stamping, and the hardness of the hot stamped product tends to be low, and (c) in a portion having a low ferrite fraction, austenite is refined in the process of heating the steel sheet and the hardness of the hot stamped product tends to be high.

(D) By using a steel sheet manufactured without annealing after being subjected to cold rolling step (also referred to as a steel sheet as cold-rolled or full hard) as the steel sheet for hot stamping, the occurrence of cracking when the formed product is deformed is suppressed.

The reason for this is not clear, but this is presumably due to the following reasons: (a) since work strain during cold rolling is stored in the steel sheet as cold-rolled, austenite is refined in the process of heating the steel sheet in the step of performing hot stamping and the hardness of the hot stamped product increases, and (b) this effect is strong in the portion having a low Mo concentration and the portion having a high ferrite fraction, and by using the steel sheet as cold-rolled, a local fluctuation in hardness in the hot stamped product is reduced.

(E) In steps of manufacturing the steel sheet for hot stamping, by performing annealing (also referred to as first hot-rolled sheet annealing) in which the steel sheet after hot rolling is heated to higher than an $Ac_3$ point and is held for a long period of time, a local fluctuation in the Mo concentration of the steel sheet for hot stamping is reduced.

(F) In the steps of manufacturing the steel sheet for hot stamping, by performing annealing (also referred to as second hot-rolled sheet annealing) in which heating to higher than the $Ac_3$ point and holding for a short period of time are performed subsequent to the first hot-rolled sheet annealing, a local fluctuation in hardness of the steel sheet for hot stamping is reduced.

The reason for this is not clear, but this is presumably due to the following reasons: (a) in the first hot-rolled sheet annealing, austenite tends to coarsen during the annealing, and coarse ferrite is localized after the annealing, and (b) in the second hot-rolled sheet annealing, austenite is less likely to coarsen during the annealing and ferrite is uniformly and finely dispersed after the annealing.

Based on the above findings (A) to (F), the present inventors found that it is possible to manufacture a hot stamped product having a small local fluctuation in hardness, a tensile strength of 2,300 MPa or more, and excellent collision resistance by performing hot stamping using a steel sheet for hot stamping having a small local fluctuation in Mo concentration and further having a small local fluctuation in hardness. Hereinafter, each requirement of a steel sheet for hot stamping according to an embodiment of the present invention (steel sheet for hot stamping according to the present embodiment) will be described in detail.

<Chemical Composition of Steel Sheet for Hot Stamping>

The steel sheet for hot stamping according to the present embodiment has the following chemical composition. The reasons for limiting each element are as follows. In the following description, "%" regarding the amount of an element means "mass %". A numerical range expressed using "to" includes numerical values before and after "to". Numerical values expressed using "less than" or "more than" are not included in the range.

C: More Than 0.40% and 0.70% or Less

C is an element having an effect of increasing a tensile strength of a steel sheet (a steel sheet provided in a hot stamped product) after hot stamping. When a C content is 0.40% or less, the tensile strength of the steel sheet after hot stamping becomes less than 2,300 MPa, and a strength of the hot stamped product is insufficient. Therefore, the C content is set to more than 0.40%. A preferable C content is more than 0.42%, more than 0.43%, more than 0.44%, or more than 0.45%.

On the other hand, when the C content is more than 0.70%, the strength of the hot stamped product becomes too high, and collision resistance cannot be secured. Therefore, the C content is set to 0.70% or less. A preferable C content is 0.65% or less, 0.60% or less, 0.55% or less, or 0.50% or less.

Si: Less Than 2.00%

Si is an element that is contained in steel as an impurity and embrittles the steel. When a Si content is 2.00% or more, an adverse effect thereof becomes particularly significant. Therefore, the Si content is set to less than 2.00%. A preferable Si content is less than 1.50%, less than 1.00%, less than 0.75%, or less than 0.50%.

A lower limit of the Si content is not particularly limited, but an excessive decrease in the Si content causes an increase in steelmaking cost. Therefore, the Si content is preferably set to 0.001% or more. In addition, Si has an action of enhancing the hardenability of steel and thus may be contained positively. From the viewpoint of improving the hardenability, the Si content is preferably set to 0.10% or more, 0.20% or more, or 0.30% or more.

Mn: 0.01% or More and Less Than 0.50%

Mn is an element that deteriorates the collision resistance of the hot stamped product. In particular, when a Mn content is 0.50% or more, collision resistance significantly deteriorates, and the collision resistance of the hot stamped product cannot be secured even when a manufacturing method of a steel sheet for hot stamping described later is applied. Therefore, the Mn content is set to less than 0.50%. The Mn content is preferably less than 0.45%, less than 0.40%, less than 0.35%, or less than 0.30%.

On the other hand, Mn is an element that is bonded to S which is an impurity to form MnS and thus has an action of suppressing harmful influence due to S. In order to obtain this effect, the Mn content is set to 0.01% or more. The Mn content is preferably 0.05% or more or 0.10% or more. Mn is an element that improves the hardenability of steel. From the viewpoint of improving the hardenability, the Mn content is preferably 0.15% or more, 0.20% or more, or 0.25% or more.

P: 0.200% or Less

P is an element contained in steel as an impurity and embrittles the steel. When a P content is more than 0.200%, an adverse effect thereof becomes particularly significant, and weldability also significantly deteriorates. Therefore, the P content is set to 0.200% or less. A preferable P content is less than 0.100%, less than 0.050%, or less than 0.020%.

A lower limit of the P content is not particularly limited, but an excessive decrease in the P content causes an increase in steelmaking cost. Therefore, the P content may be set to 0.001% or more.

S: 0.0200% or Less

S is an element that is contained in steel as an impurity and embrittles the steel. When a S content is more than 0.0200%, an adverse effect thereof becomes particularly significant. Therefore, the S content is set to 0.0200% or less. A preferable S content is less than 0.0050%, less than 0.0020%, or less than 0.0010%.

A lower limit of the S content is not particularly limited, but an excessive decrease in the S content causes an increase in steelmaking cost. Therefore, the S content may be set to 0.0001% or more.

sol. Al: 0.001% to 1.000%

Al is an element having an action of deoxidizing molten steel. When a sot. Al content (acid-soluble Al content) is less than 0.001%, deoxidation is insufficient. Therefore, the sol. Al content is set to 0.001% or more. The sol. Al content is preferably 0.005% or more, 0.010% or more, or 0.020% or more.

On the other hand, when the sol. Al content is too large, a transformation point rises, and it becomes difficult to heat the steel sheet to a temperature of higher than an $Ac_3$ point in manufacturing steps of the steel sheet for hot stamping. Therefore, the sol. Al content is set to 1.000% or less. The sol. Al content is preferably less than 0.500%, less than 0.100%, less than 0.060%, or less than 0.040%.

N: 0.0200% or Less

N is an element that is contained in steel as an impurity and forms nitrides during continuous casting of the steel. Since these nitrides deteriorate ductility of the steel sheet after hot stamping, a N content is preferably low. When the N content is more than 0.0200%, an adverse effect thereof becomes particularly significant. Therefore, the N content is set to 0.0200% or less. The N content is preferably less than 0.0100%, less than 0.0080%, or less than 0.0050%.

A lower limit of the N content is not particularly limited, but an excessive decrease in the N content causes an increase in steelmaking cost. Therefore, the N content may be set to 0.0010% or more.

Mo: 0.01% or More and Less Than 0.50%

Mo is an element that improves the hardenability of steel and is an effective element for forming a metallographic microstructure primarily including martensite in a step of performing hot stamping and securing the strength of the hot stamped product. In order to obtain this effect, a Mo content is set to 0.01% or more. A preferable Mo content is 0.05% or more, 0.10% or more, or 0.15% or more.

On the other hand, when the Mo content is 0.50% or more, a local fluctuation in Mo concentration cannot be suppressed in the steel sheet for hot stamping even if the manufacturing method of a steel sheet for hot stamping described later is applied, and the collision resistance of the hot stamped product cannot be sufficiently secured. Therefore, the Mo content is set to less than 0.50%. The Mo content is preferably less than 0.40%, less than 0.35%, or less than 0.30%.

B: 0.0002% to 0.0200%

B is an element that improves the hardenability of steel, and is an effective element for forming a metallographic microstructure primarily including martensite in the step of performing hot stamping and securing the strength of the hot stamped product. In order to obtain this effect, a B content is set to 0.0002% or more. A preferable B content is 0.0006% or more, 0.0010% or more, or 0.0015% or more.

On the other hand, in a case where the B content is more than 0.0200%, borocarbides are formed, and an effect of improving the hardenability by including B is impaired. Therefore, the B content is set to 0.0200% or less. A preferable B content is less than 0.0050%, less than 0.0040%, or less than 0.0030%.

The steel sheet for hot stamping according to the present embodiment may have a chemical composition containing the above-described chemical elements and a remainder of Fe and impurities. However, in order to improve properties and the like, the steel sheet for hot stamping according to the present embodiment may further contain one or more selected from Ti, Nb, V, Zr, Cr, W, Cu, Ni, Ca, Mg, REM, and Bi in the ranges shown below. These elements (optional elements) do not necessarily have to be contained. Therefore, lower limits thereof are 0%.

Here, the "impurities" mean elements that are incorporated from raw materials such as ore and scrap or due to various factors in the manufacturing steps when the steel sheet is industrially manufactured, and are acceptable in a range without adversely affecting the steel sheet for hot stamping according to the present embodiment.

Ti: 0% to 0.200%

Nb: 0% to 0.200%

V: 0% to 0.200%

Zr: 0% to 0.200%

Ti, Nb, V, and Zr are elements having an action of improving the collision resistance of the hot stamped product through the refinement of the metallographic microstructure. In order to obtain this effect, one or more selected from Ti, Nb, V, and Zr may be contained as necessary.

In a case where the above effect is desired, one or more selected from Ti, Nb, V, and Zr are each contained preferably in an amount of 0.001% or more, more preferably in an amount of 0.005% or more, and even more preferably in an amount of 0.010% or more.

On the other hand, in a case where the amounts of Ti, Nb, V, and Zr are each more than 0.200%, the effect is saturated and a manufacturing cost of the steel sheet increases. Therefore, in a case where the above elements are contained, the amounts of Ti, Nb, V, and Zr are each set to 0.200% or less.

Moreover, in a case where the amounts of Ti, Nb, V, and Zr are large, carbides of these elements precipitate in a large amount and the ductility of the steel sheet after hot stamping are impaired. From the viewpoint of securing the ductility, a preferable Ti content is less than 0.050% or less than 0.030%, a preferable Nb content is less than 0.050%, less than 0.030%, or less than 0.020%, a preferable V content is less than 0.100% or less than 0.050%, and a preferable Zr content is less than 0.100% or less than 0.050%.

Cr: 0% to 2.00%

W: 0% to 2.00%

Cu: 0% to 2.00%

Ni: 0% to 2.00%

Cr, W, Cu, and Ni are elements having an action of enhancing the hardenability of steel. Therefore, one or more selected from Cr, W, Cu, and Ni may be contained as necessary.

In a case where the above effect is desired, it is preferable that one or more selected from Cr, W, Cu, and Ni are each contained in an amount of 0.001% or more. A more preferable Cr content is 0.05% or more or 0.10% or more, a more preferable W content is 0.05% or more or 0.10% or more, a more preferable Cu content is 0.10% or more, and a more preferable Ni content is 0.10% or more.

On the other hand, when the amounts of Cr, W, Cu, and Ni are each more than 2.00%, the collision resistance of the hot stamped product deteriorates. Therefore, in a case where the above elements are contained, the amounts of Cr, W, Cu, and Ni are each set to 2.00% or less. A preferable Cr content is less than 0.50%, less than 0.40%, or less than 0.30%, a preferable W content is less than 0.50%, less than 0.40%, or less than 0.30%, a preferable Cu content is less than 1.00% or less than 0.50%, or a preferable Ni content is less than 1.00% or less than 0.50%.

Ca: 0% to 0.0100%

Mg: 0% to 0.0100%

REM: 0% to 0.1000%

Ca, Mg, and REM are elements having an action of improving the ductility of the steel sheet after hot stamping by controlling shapes of inclusions. Therefore, these elements may be contained as necessary. In a case where the above effect is desired, it is preferable that one or more selected from Ca, Mg, and REM are each contained in an amount of 0.0001% or more.

On the other hand, in a case where a Ca or Mg content is more than 0.0100%, or in a case where a REM content is more than 0.1000%, not only is the above effect saturated, but also an excessive cost is incurred. Therefore, in a case where the above elements are contained, the Ca and Mg contents are each set to 0.0100% or less, and the REM content is set to 0.1000% or less.

In the present embodiment, REM refers to a total of 17 elements of Sc, Y, and lanthanoids, and the REM content means the total amount of these elements. Lanthanoids are industrially added in the form of mischmetal.

Bi: 0% to 0.0500%

Bi is an element having an action of improving the collision resistance of the hot stamped product by refining a solidification structure. Therefore, Bi may be contained as necessary. In a case where the above effect is desired, a Bi content is preferably 0.0001% or more. A more preferable Bi content is 0.0003% or more, or 0.0005% or more.

On the other hand, in a case where the Bi content is more than 0.0500%, the above effect is saturated and an excessive cost is incurred. Therefore, in a case where Bi is contained, the Bi content is set to 0.0500% or less. A preferable Bi content is 0.0100% or less or 0.0050% or less.

As described above, the chemical composition of the steel sheet for hot stamping according to the present embodiment may contain essential elements and the remainder of Fe and impurities, or may contain essential elements, one or more optional elements, and the remainder of Fe and impurities.

<Mo Concentration Distribution of Steel Sheet for Hot Stamping>

A local distribution of alloying elements concentration of the steel sheet for hot stamping according to the present embodiment will be described. In the steel sheet for hot stamping according to the present embodiment, when the Mo content of the steel sheet is measured by line analysis in a range of 0.05 mm in a sheet thickness direction, in which a ¼ depth position of a sheet thickness of the steel sheet from a surface of the steel sheet is a center, a maximum value of the Mo content, a minimum value of the Mo content, and an average value of the Mo content in measurement results satisfy Expression (i).

$$([Mo]_{MAX} - [Mo]_{MIN})/[Mo]_{AVE} < 0.50 \quad \text{(i)}$$

Here, the meaning of each symbol in Expression (i) is as follows.

$[Mo]_{MAX}$: the maximum value of the Mo content (mass %)

$[Mo]_{MIN}$: the minimum value of the Mo content (mass %)

$[Mo]_{AVE}$: the average value of the Mo content (mass %)

When the Mo content of the steel sheet for hot stamping in the above range satisfies Expression (i), the collision resistance of the hot stamped product can be improved. A left side value in Expression (i) is preferably less than 0.40 or less than 0.30.

A lower limit of the left side value of Expression (i) is not limited. However, in order to significantly lower the left side value of Expression (i), in the manufacturing method of a steel sheet for hot stamping described later, it is necessary to excessively raise a soaking temperature or excessively lengthen a soaking time in first hot-rolled sheet annealing. In this case, not only is productivity of the steel sheet for hot stamping impaired, but also a local fluctuation in hardness of the steel sheet for hot stamping increases. Therefore, the left side value of Expression (i) may be 0.05 or more, 0.10 or more, or 0.15 or more.

In the present embodiment, a local Mo content (concentration) distribution is obtained as follows.

First, a test piece is collected from the steel sheet for hot stamping, and a longitudinal section of the steel sheet parallel to a rolling direction is polished with waterproof abrasive paper. Furthermore, buffing is performed using a diamond suspension, and line analysis is then performed on a range of 0.05 mm in the sheet thickness direction, in which the ¼ depth position of the sheet thickness of the steel sheet from the surface of the steel sheet in the sheet thickness direction of the steel sheet is a center, using a field emission electron probe micro-analyzer (FE-EPMA). The EPMA measurement is performed at intervals of 0.2 μm in the sheet thickness direction, and the Mo content at each measurement position is obtained from a five-point moving average value. Specifically, an average value of measurement values of Mo concentrations at five consecutive points is set as the Mo content at a third measurement position, and the Mo content at each measurement position in the above range is obtained. From a maximum value, a minimum value, and an average value (an average value of the Mo contents at all the measurement positions) of the Mo contents in the above range obtained as described above, a left side value of Expression (i) is obtained. However, this line analysis is performed at any 10 points on the steel sheet, and an average value of the left side values obtained at the 10 points is regarded as the left side value of Expression (i) in the steel sheet.

<Hardness Distribution of Steel Sheet for Hot Stamping>

In the steel sheet for hot stamping according to the present embodiment, a standard deviation of a Vickers hardness in a region of 0.18 $mm^2$ (a region of 0.3 mm in the sheet thickness direction and 0.6 mm in a direction perpendicular to the sheet thickness direction, in which the ¼ depth position of the steel sheet is a center) is 20 (Hv) or less (20 or less in the unit of Hv).

In a case where the standard deviation of the Vickers hardness in the above region is more than 20 (Hv), when the hot stamped product is deformed, cracking occurs in an early stage of the deformation, and the collision resistance significantly deteriorates. Therefore, the standard deviation of the hardness in the above region is set to 20 (Hv) or less. The standard deviation of the hardness is preferably set to 15 (Hv) or less or 10 (Hv) or less.

In addition, the steel sheet for hot stamping according to the present embodiment is a steel sheet as cold-rolled, and an average value of the hardness is an index of strain energy stored in the steel sheet. In order to increase the strain energy and improve the collision resistance of the hot stamped product, the average value of the hardness is preferably set to 280 (Hv) or more, 295 (Hv) or more, or 310 (Hv) or more.

The standard deviation of the hardness in the above region is preferably as small as possible. However, a significant decrease in the standard deviation of the hardness causes a decrease in the productivity of the steel sheet for hot stamping. Therefore, the standard deviation of the hardness may be more than 5 (Hv) or more than 10 (Hv). The average value of the hardness in the above region is preferably as large as possible. However, a significant increase in the average value of the hardness not only causes a decrease in the productivity of the steel sheet for hot stamping but also deteriorates cutability of the steel sheet for hot stamping. Therefore, the average value of the hardness may be 400 (Hv) or less or 370 (Hv) or less.

In the present embodiment, the hardness of the steel sheet for hot stamping is obtained as follows.

First, a test piece is collected from the steel sheet for hot stamping, a longitudinal section of the steel sheet parallel to the rolling direction is polished with waterproof abrasive paper and is further buffed using a diamond suspension, and a Vickers hardness is measured at the ¼ depth position of the steel sheet.

Specifically, as shown in FIG. 1, in a range of 0.3 mm in the sheet thickness direction and 0.6 mm in the direction perpendicular to the sheet thickness direction, in which the ¼ depth position of the steel sheet is a center, the Vickers hardness is measured at 45 points at predetermined intervals, and an arithmetic average value and a standard deviation are obtained from the obtained measurement values. A micro-Vickers hardness tester is used for the measurement of the hardness, and measurement conditions include a load of 0.49 N and a load holding time of 10 seconds. When the load is high, dimensions of an indentation become large, and a local hardness distribution that is closely related to the collision resistance of the hot stamped product cannot be evaluated. Therefore, the load is set to 0.49 N.

<Strength of Steel Sheet for Hot Stamping>

The steel sheet for hot stamping according to the present embodiment preferably has a tensile strength of 900 MPa or more in order to increase the strain energy and improve the collision resistance of the hot stamped product. A more preferable tensile strength is 950 MPa or more or 1,000 MPa or more.

<Metallographic microstructure of Steel Sheet for Hot Stamping>

Since the steel sheet for hot stamping according to the present embodiment is manufactured without annealing after a cold rolling step, the steel sheet for hot stamping according to the present embodiment has a metallographic microstructure stretched in the rolling direction. With such a metallographic microstructure, the strain energy of the steel sheet for hot stamping is increased, and the collision resistance of the hot stamped product is improved. In a steel sheet that is annealed after cold rolling, the stored strain energy is not sufficient, and the collision resistance of the hot stamped product decreases.

When martensite (including tempered martensite) is contained in the metallographic microstructure, the steel sheet is significantly hardened, and it is difficult to cut the steel sheet. Therefore, it is preferable that the metallographic microstructure of the steel sheet for hot stamping primarily contains ferrite, pearlite, and/or bainite stretched in the rolling direction. A total volume percentage of ferrite stretched in the rolling direction, pearlite stretched in the rolling direction, and bainite stretched in the rolling direction is preferably more than 80.0%, more than 90.0%, or more than 95.0%.

In the metallographic microstructure, a remainder other than ferrite, pearlite, and bainite stretched in the rolling direction may include martensite and/or retained austenite, and may further include precipitates such as cementite. A volume percentage of the remainder is preferably 20.0% or less. A volume percentage of martensite is preferably less than 10.0% or less than 5.0%.

The volume percentage of each structure in the metallographic microstructure of the steel sheet for hot stamping is obtained as follows.

First, a test piece is collected from the steel sheet for hot stamping, a longitudinal section of the steel sheet parallel to the rolling direction is polished with waterproof abrasive paper and is further buffed using a diamond suspension, and structure observation is then performed at the ¼ depth position of the sheet thickness of the steel sheet from the surface of the steel sheet.

Specifically, the polished surface is subjected to nital etching or electrolytic polishing, structure observation is then performed using an optical microscope and a scanning electron microscope (SEM), and image analysis based on a difference in luminance or a difference in morphology of iron carbides present in phases is performed on the obtained structure photograph to obtain an area ratio of each of ferrite, pearlite, bainite, and tempered martensite. Thereafter, LePera corrosion is applied to the same observation position, structure observation is then performed using the optical microscope and the scanning electron microscope (SEM), and image analysis is performed on the obtained structure photograph to calculate a total area ratio of retained austenite and martensite.

In addition, the longitudinal section parallel to the rolling direction of the steel sheet is subjected to electrolytic polishing at the same observation position, and an area ratio of retained austenite is then measured based on a difference in crystal structure using a SEM provided with an electron backscatter diffraction pattern analyzer (EBSP).

Based on these results, the area ratio of each of ferrite, pearlite, bainite, tempered martensite, martensite, and retained austenite is obtained. Assuming that the area ratio is equal to the volume percentage, the measured area ratio is regarded as the volume percentage of each structure.

During the structure observation, tempered martensite can be distinguished from martensite by the presence of iron carbides inside, and can be distinguished from bainite by the fact that iron carbides present inside are stretched in a plurality of directions.

<Manufacturing Method of Steel Sheet for Hot Stamping>

Next, a preferred manufacturing method of the steel sheet for hot stamping according to the present embodiment will be described.

The steel sheet for hot stamping according to the present embodiment can be manufactured by a manufacturing method including the following steps:

(I) a hot rolling step of performing hot rolling on a slab having the above-described chemical composition and then coiling the slab into a hot-rolled steel sheet;

(II) a first hot-rolled sheet annealing step of performing first hot-rolled sheet annealing on the hot-rolled steel sheet to obtain a hot-rolled and annealed steel sheet;

(III) a second hot-rolled sheet annealing step of performing second hot-rolled sheet annealing on the hot-rolled and annealed steel sheet; and (IV) a cold rolling step of performing cold rolling on the hot-rolled and annealed steel sheet subjected to the second hot-rolled sheet annealing to obtain a cold-rolled steel sheet.

A manufacturing method of the slab provided for the manufacturing method of the steel sheet for hot stamping according to the present embodiment is not particularly limited. In a preferable manufacturing method of the slab exemplified, a steel having the above-described composition (chemical composition) is melted by a known method, thereafter made into a steel ingot by a continuous casting method, or made into a steel ingot by any casting method, and then made into a steel piece by a blooming method or the like. In a continuous casting step, in order to suppress the occurrence of surface defects due to inclusions, it is preferable to cause an external additional flow to occur in molten steel in a mold by electromagnetic stirring or the like. The steel ingot or steel piece may be reheated after being cooled once and subjected to hot rolling, or the steel ingot in a high temperature state after the continuous casting or the steel piece in a high temperature state after the blooming may be subjected to hot rolling as it is, after being kept hot, or after being subjected to auxiliary heating. In the present embodiment, the steel ingot and the steel piece are collectively referred to as a "slab" as a material of hot rolling.

[Hot Rolling Step]

A temperature of the slab to be subjected to the hot rolling (slab heating temperature) is set to preferably lower than 1,250° C., and more preferably 1,200° C. or lower in order to prevent coarsening of austenite. On the other hand, when the slab heating temperature is low, it is difficult to perform rolling. Therefore, the slab heating temperature may be set to 1,050° C. or higher.

The heated slab is hot-rolled, thereby obtaining a hot-rolled steel sheet. The hot rolling is preferably completed in a temperature range of an $Ar_3$ point or higher in order to refine a metallographic microstructure of the hot-rolled steel sheet by transforming austenite after completion of rolling.

In a case where the hot rolling includes rough rolling and finish rolling, a rough-rolled material may be heated between the rough rolling and the finish rolling in order to complete the finish rolling at the above temperature. At this time, it is desirable to suppress a temperature fluctuation over the entire length of the rough-rolled material at the start of the finish rolling to 140° C. or lower by performing heating such that a rear end of the rough-rolled material has a higher temperature than a front end thereof. This improves uniformity of product characteristics in the coil after the coiling step.

A heating method of the rough-rolled material may be performed using a known method. For example, a solenoid induction heating device may be provided between a roughing mill and a finishing mill, and an increase in the heating temperature may be controlled based on a temperature distribution and the like in a longitudinal direction of the rough-rolled material on an upstream side of the induction heating device.

In a case where the hot-rolled steel sheet after the hot rolling is coiled, a coiling temperature is preferably set to 660° C. or lower in order to suppress a local fluctuation in the Mo concentration. A more preferable coiling temperature is 640° C. or lower or 620° C. or lower.

On the other hand, when the coiling temperature becomes too low, there are cases where the steel sheet is significantly hardened, and cracking occurs in the steel sheet in the manufacturing steps of the steel sheet. Therefore, the coiling temperature is preferably set to higher than 500° C. or higher than 550° C.

[First Hot-Rolled Sheet Annealing Step]

The steel sheet that is hot-rolled and coiled is subjected to the first hot-rolled sheet annealing to obtain a hot-rolled and annealed steel sheet. In the present embodiment, annealing performed on a hot-rolled steel sheet is called hot-rolled sheet annealing, and a steel sheet after being subjected to the hot-rolled sheet annealing is called a hot-rolled and annealed steel sheet. Before the first hot-rolled sheet annealing, flattening by skin pass rolling or the like or descaling by pickling or the like may be performed.

In the first hot-rolled sheet annealing step, a soaking temperature is set to an $Ac_3$ point (° C.) or higher, and a soaking time (holding time at the soaking temperature) is set to longer than one hour. In addition, an average cooling rate from the soaking temperature to 500° C. is set to faster than 1° C./sec. This is to suppress a local fluctuation in the Mo concentration and to improve the collision resistance of the hot stamped product. A more preferable soaking temperature is ($Ac_3$ point+50° C.) or higher, a more preferable soaking time is 2 hours or longer or 6 hours or longer, and a more preferable average cooling rate to 500° C. is 2° C./sec or faster. In a case where the soaking temperature is too high or the soaking time is too long, austenite becomes excessively coarse, and a local fluctuation in the hardness of the steel sheet for hot stamping increases. Therefore, the soaking temperature is preferably set to be ($Ac_3$ points+200° C.) or lower or ($Ac_3$ point+100° C.) or lower, and the soaking time is preferably set to 12 hours or shorter or 10 hours or shorter.

The $Ac_3$ point is a temperature at which ferrite disappears in the metallographic microstructure when the steel sheet is heated, and is obtained from a change in thermal expansion when the steel sheet is heated at 8° C./sec in the present embodiment.

[Second Hot-Rolled Sheet Annealing Step]

The second hot-rolled sheet annealing is performed on the steel sheet (hot-rolled and annealed steel sheet) subjected to the first hot-rolled sheet annealing. Annealing performed on a hot-rolled and annealed steel sheet is also called hot-rolled sheet annealing. Before the second hot-rolled sheet annealing, flattening by skin pass rolling or the like or descaling by pickling or the like may be performed.

In the second hot-rolled sheet annealing step, a soaking temperature is set to the $Ac_3$ point or higher and ($Ac_3$ point+50° C.) or lower, and a soaking time is set to 1 second or longer and shorter than 10 minutes. In addition, an average heating rate from 500° C. to the soaking temperature is set to faster than 1° C./sec, and an average cooling rate from the soaking temperature to 500° C. is set to faster than 1° C./sec. This is to suppress a local fluctuation in the hardness of the steel sheet for hot stamping and to improve the collision resistance of the hot stamped product. A more preferable soaking temperature is the $Ac_3$ point or higher and ($Ac_3$ point+25° C.) or lower, a more preferable soaking time is 10 seconds or longer and shorter than 5 minutes, and a more preferable average heating rate from 500° C. to the soaking temperature is 2° C./sec or faster. When the average cooling rate from the soaking temperature to 500° C. is too fast, the steel sheet is significantly hardened, and it is difficult to cut the steel sheet. Therefore, the cooling rate is preferably set to 15° C./sec or slower.

[Cold Rolling Step]

The steel sheet subjected to the second hot-rolled sheet annealing (hot-rolled and annealed steel sheet) is cold-rolled according to a normal method to obtain a cold-rolled steel sheet. In the cold rolling step, a cold rolling reduction (cumulative rolling reduction in cold rolling) is set to 10% or more. When the cold rolling reduction is less than 10%, the strain energy stored in the steel sheet is insufficient, a local fluctuation in the hardness in the steel sheet increases, and the collision resistance of the hot stamped product decreases. A preferable cold rolling reduction is 20% or more, 30% or more, or 40% or more. It is not necessary to particularly limit an upper limit of the cold rolling reduction. However, since an excessive increase in the cold rolling reduction increases a load on a rolling facility and causes a decrease in productivity, the cold rolling reduction is preferably set to less than 70%, less than 60%, or less than 50%.

In order to reduce a weight of the hot stamped product, a sheet thickness of the cold-rolled steel sheet is preferably 2.0 mm or less, more preferably 1.8 mm or less, and even more preferably 1.6 mm or less. Before the cold rolling, flattening by skin pass rolling or the like or descaling by pickling or the like may be performed according to known methods.

It is preferable that the cold-rolled steel sheet is not annealed. When the cold-rolled steel sheet is annealed, strain energy stored during cold rolling is released. In addition, there may be cases where a local fluctuation in the hardness of the steel sheet increases. In a case where such a steel sheet is used as a steel sheet for hot stamping, the collision resistance of the hot stamped product deteriorates. The cold-rolled steel sheet obtained in this manner may be subjected to a treatment such as degreasing and lubrication according to a normal method.

A hot stamped product can be obtained by hot-stamping the above-described steel sheet for hot stamping according to the present embodiment. The hot stamped product manufactured using the steel sheet for hot stamping according to the present embodiment (hereinafter, a hot stamped product according to the present embodiment) will be described.

The hot stamped product according to the present embodiment includes a base steel sheet (a steel sheet forming a hot stamped product obtained by hot-stamping a steel sheet for hot stamping). The hot stamped product according to the present embodiment may include only the base steel sheet.

<Chemical Composition of Base Steel Sheet of Hot Stamped Product>

Since the chemical composition is not substantially changed by hot stamping, a chemical composition of the base steel sheet of the hot stamped product (or the chemical composition of the hot stamped product in a case where the hot stamped product includes only the base steel sheet) is the same as the above-described steel sheet for hot stamping. In a case where the hot stamped product includes a portion having a tensile strength of 2,300 MPa or more and a portion having a tensile strength of less than 2,300 MPa, at least a portion of the base steel sheet having a tensile strength of 2,300 MPa or more may have the above-described chemical composition.

<Mo Concentration Distribution of Base Steel Sheet of Hot Stamped Product>

In the hot stamped product according to the present embodiment, when a Mo content is measured by line analysis in a range of 0.05 mm in a sheet thickness direction, in which a ¼ depth position of a sheet thickness of the base steel sheet from a surface of the base steel sheet (a steel sheet provided in a hot stamped product) is a center, a maximum value of the Mo content, a minimum value of the Mo content, and an average value of the Mo content in measurement results satisfy Expression (ii).

$$([Mo]_{mMAX} - [Mo]_{nMIN})/[Mo]_{mAVE} < 0.50 \quad \text{(ii)}$$

Here, the meaning of each symbol in Expression (ii) is as follows.

$[Mo]_{mMAX}$: the maximum value of the Mo content of the base steel sheet (mass %)

$[Mo]_{mMIN}$: the minimum value of the Mo content of the base steel sheet (mass %)

$[Mo]_{mAVE}$: the average value of the Mo content of the base steel sheet (mass %)

In a case where the hot stamped product includes a portion having a tensile strength of 2,300 MPa or more and a portion having a tensile strength of less than 2,300 MPa, at least a portion of the base steel sheet having a tensile strength of 2,300 MPa or more may satisfy Expression (ii).

As a local fluctuation in the Mo concentration in the hot stamped product decreases, a stress concentration on a soft portion is relaxed when the hot stamped product is deformed, and the occurrence of cracking is suppressed. Therefore, a left side value of Expression (ii) is preferably less than 0.50. The left side value of Expression (ii) is more preferably less than 0.40 or less than 0.30.

A lower limit of the left side value of Expression (ii) is not limited. However, a significant decrease in the left side value of Expression (ii) causes a decrease in the productivity of the steel sheet for hot stamping. Therefore, the left side value of Expression (ii) may be 0.05 or more, 0.10 or more, or 0.15 or more.

The local distribution in the Mo concentration in the hot stamped product can be obtained by collecting a test piece from the hot stamped product, buffing a longitudinal section of the steel sheet, and then performing concentration analysis at the ¼ depth position of the base steel sheet in the same method as in the case of the steel sheet for hot stamping. In a case where the hot stamped product has a portion having a tensile strength of 2,300 MPa or more and a portion having a tensile strength of less than 2,300 MPa, the test piece is collected from at least a portion of the base steel sheet having a tensile strength of 2,300 MPa or more to perform the concentration analysis.

<Metallographic microstructure of Base Steel Sheet of Hot Stamped Product>

In the hot stamped product manufactured using the steel sheet for hot stamping according to the present embodiment, it is preferable that the base steel sheet has the following metallographic microstructure. In a case where the hot stamped product includes a portion having a tensile strength of 2,300 MPa or more and a portion having a tensile strength of less than 2,300 MPa, it is preferable that at least a portion of the base steel sheet having a tensile strength of 2,300 MPa or more has the following metallographic microstructure.

Martensite: More Than 90.0%

Martensite is an important structure for increasing the tensile strength of the steel sheet after hot stamping. When a volume percentage of martensite is 90.0% or less, the tensile strength of the hot stamped product becomes less than 2,300 MPa, and the strength is insufficient. Therefore, the volume percentage of martensite is preferably set to more than 90.0%. A more preferable volume percentage of martensite is more than 91.0%, more than 93.0%, or more than 95.0%.

An upper limit of the volume percentage of martensite does not need to be particularly set %. However, in order to significantly increase the volume percentage of martensite, it is necessary to excessively increase a heating temperature of the steel sheet or excessively increase a cooling rate in the step of performing hot stamping, which significantly impairs productivity of the hot stamped product. Therefore, the volume percentage of martensite is preferably set to 99.0% or less, or 98.0% or less.

The martensite includes, in addition to fresh martensite that has not been tempered, tempered martensite that has been tempered and has iron carbides present therein.

A remainder of the metallographic microstructure may contain ferrite, pearlite, bainite, or retained austenite, and may further contain precipitates such as cementite. Since it is not necessary to contain ferrite, pearlite, bainite, retained austenite, and precipitates, lower limits of volume percentages of ferrite, pearlite, bainite, retained austenite, and precipitates are all 0%.

Since ferrite, pearlite, and bainite have an action of improving ductility of the steel sheet after hot stamping, in a case where this effect is obtained, it is preferable to include one or more selected from ferrite, pearlite, and bainite. The volume percentage of ferrite is preferably set to 0.5% or more or 1.0% or more, the volume percentage of each of pearlite and bainite is set to preferably 1.0% or more, and more preferably 2.0% or more.

On the other hand, when ferrite, pearlite, and bainite are excessively contained, the collision resistance of the hot stamped product deteriorates. Therefore, the volume percentage of ferrite is preferably set to less than 3.0% or less than 2.0%, and the volume percentage of each of pearlite and bainite is set to preferably less than 10.0%, and more preferably less than 5.0%.

Retained austenite has an action of improving the ductility of the steel sheet after hot stamping. In a case where this effect is obtained, the volume percentage of retained austenite is preferably set to 0.5% or more, 1.0% or more, or 2.0% or more.

On the other hand, in order to excessively increase the volume percentage of retained austenite, it is necessary to perform an austempering treatment at a high temperature after hot stamping, which significantly reduces the productivity of the hot stamped product. In addition, when retained austenite is excessively contained, there are cases where the collision resistance of the hot stamped product deteriorates. Therefore, the volume percentage of retained austenite is preferably set to less than 9.0%, less than 7.0%, less than 5.0%, or less than 4.0%.

The volume percentage of each structure in the metallographic microstructure of the hot stamped product can be obtained by collecting a test piece from the hot stamped product, buffing a longitudinal section of the steel sheet, and then performing structure observation at the ¼ depth position of the base steel sheet in the same method as in the case of the steel sheet for hot stamping. In a case where the hot stamped product has a portion having a tensile strength of 2,300 MPa or more and a portion having a tensile strength of less than 2,300 MPa, the test piece is collected from at least a portion of the base steel sheet having a tensile strength of 2,300 MPa or more to perform the structure observation.

<Strength of Base Steel Sheet of Hot Stamped Product>

The entirety or a part of the hot stamped product according to the present embodiment preferably has a tensile strength of 2,300 MPa or more. For this purpose, the tensile strength of the entirety or a part of the base steel sheet of the hot stamped product is 2,300 MPa or more. When the tensile strength of at least a part of the hot stamped product is not 2,300 MPa or more, the collision resistance of the hot stamped product cannot be secured. Therefore, the tensile strength of the entirety or a part of the hot stamped product is set to 2.300 MPa or more. Preferably, the tensile strength is 2,400 MPa or more, or 2,500 MPa or more in the entirety or a part of the hot stamped product. On the other hand, an excessive increase in the strength of the hot stamped product causes a decrease in the collision resistance. Therefore, the tensile strength of the base steel sheet of the hot stamped product is preferably set to less than 3,000 MPa or less than 2,800 MPa.

The entirety of the hot stamped product according to the present embodiment (the entire formed product) may have a tensile strength of 2,300 MPa or more. However, a portion having a tensile strength of 2,300 MPa or more and a portion having a tensile strength of less than 2,300 MPa may be mixed in the hot stamped product. By providing the portions having different strengths, it is possible to control the deformation state of the hot stamped product in a collision. The hot stamped product having portions with different strengths can be manufactured by a method of performing hot stamping after joining two or more types of steel sheets having different chemical compositions, a method of partially changing a heating temperature of a steel sheet or a cooling rate after hot stamping in a step of performing hot stamping, a method of partially reheating a hot stamped product, or the like.

<Hardness Distribution of Base Steel Sheet of Hot Stamped Product>

In the hot stamped product according to the present embodiment, a standard deviation of a Vickers hardness in a region of 0.18 $mm^2$ (a region of 0.3 mm in the sheet thickness direction and 0.6 mm in a direction perpendicular to the sheet thickness direction, in which the ¼ depth position of the base steel sheet is a center) is 20 (Hv) or less.

In a case where the standard deviation of the Vickers hardness in the above region is more than 20 (Hv), when the hot stamped product is deformed, cracking occurs in an early stage of the deformation, and the collision resistance significantly deteriorates. Therefore, the standard deviation of the hardness in the above region is set to 20 (Hv) or less. The standard deviation of the hardness is more preferably set to 15 (Hv) or less, or 10 (Hv) or less.

In a case where the hot stamped product includes a portion having a tensile strength of 2,300 MPa or more and a portion having a tensile strength of less than 2,300 MPa, at least a portion of the base steel sheet having a tensile strength of 2,300 MPa or more may have the above-described hardness distribution.

The standard deviation of hardness in the above region is preferably as small as possible. However, a significant decrease in the standard deviation of the hardness causes a decrease in the productivity of the hot stamped product. Therefore, the standard deviation of the hardness may be more than 5 (Hv) or more than 10 (Hv). The hardness distribution of the base steel sheet in the hot stamped product can be obtained by collecting a test piece from the hot stamped product, buffing a longitudinal section of the steel sheet, and then measuring the hardness at the ¼ depth position of the base steel sheet in the same method as in the case of the steel sheet for hot stamping. In a case where the hot stamped product has a portion having a tensile strength of 2,300 MPa or more and a portion having a tensile strength of less than 2,300 MPa, the test piece is collected from at least a portion of the base steel sheet having a tensile strength of 2,300 MPa or more to measure the hardness.

<Manufacturing Method of Hot Stamped Product>

Next, a preferred manufacturing method of the hot stamped product according to the present embodiment will be described.

The hot stamped product according to the present embodiment is manufactured according to a manufacturing method including a heating step of heating the steel sheet for hot stamping according to the present embodiment, and a hot stamping step of performing hot stamping on the heated steel sheet for hot stamping to obtain a hot stamped product. In the hot stamping step, forming and cooling are performed using a die.

In the heating step, the steel sheet for hot stamping according to the present embodiment is heated before the hot stamping step. In the heating step of heating the steel sheet for hot stamping, a heating temperature is preferably set to a temperature of higher than the $Ac_3$ point. When the heating temperature is the $Ac_3$ point or lower, the volume percentage of martensite in the metallographic microstructure of the hot stamped product is insufficient, resulting in a decrease in the strength of the formed product and the deterioration of the collision resistance.

An upper limit of the heating temperature is not particularly limited. However, when the heating temperature is too high, scale is excessively generated in the hot stamped product, and the deposition of the scale in a die reduces the productivity of the formed product. Therefore, the heating temperature is preferably 1,200° C. or lower or 1,150° C. or lower.

It is not necessary to particularly limit a heating rate of the steel sheet. However, as the heating rate increases, strain energy stored in the steel sheet for hot stamping can be effectively used, and the collision resistance of the hot stamped product improves. Therefore, an average heating rate up to 700° C. is preferably set to faster than 10° C./sec, faster than 20° C./sec, faster than 30° C./sec, or faster than 50° C./sec. On the other hand, when the heating rate is too fast, the amount of coarse iron carbides produced in the metallographic microstructure of the hot stamped product becomes excessive, and the ductility of the steel sheet after hot stamping decreases. Therefore, the average heating rate is preferably slower than 150° C./sec, slower than 120° C./sec, or slower than 90° C./sec.

In the step of performing hot stamping on the heated steel sheet for hot stamping, it is preferable that the heated steel sheet is taken out of a heating furnace and subjected to air cooling in the air, and then hot stamping is started at a temperature of 700° C. or higher. When a hot stamping start temperature is lower than 700° C., the volume percentage of martensite in the metallographic microstructure of the hot stamped product is insufficient, resulting in a decrease in the strength of the formed product and the deterioration of the collision resistance.

After forming is performed by hot stamping, cooling is performed while holding the formed product in the die, and/or the formed product is taken out of the die and cooled by any method. When a cooling rate is slow, the volume percentage of martensite in the metallographic microstructure of the hot stamped product is insufficient, and the strength of the formed product decreases. Therefore, an average cooling rate from the hot stamping start temperature to 400° C. is preferably set to 30° C./sec or faster, 60° C./sec or faster, or 90° C./sec or faster. In addition, when a cooling stop temperature is high, similarly, the volume percentage of martensite in the metallographic microstructure of the hot stamped product is insufficient, and the strength of the formed product decreases. Therefore, the cooling stop temperature by the cooling is preferably set to lower than 90° C. or lower than 50° C.

The hot stamped product may be subjected to a reheating treatment. The reheating treatment reduces a local fluctuation in hardness in the hot stamped product and improves the collision resistance of the hot stamped product. In order to sufficiently obtain this effect, a reheating temperature is preferably set to 90° C. or higher. On the other hand, when the reheating temperature is too high, the steel sheet is softened and the strength of the formed product is insufficient. Therefore, the reheating temperature is preferably set to lower than 200° C. or lower than 150° C.

When a holding time at the heating temperature is short, the above effect cannot be sufficiently obtained. On the other hand, when the holding time is long, the strength of the formed product is insufficient. Therefore, a lower limit of the holding time is preferably 5 minutes or longer or 10 minutes or longer, and an upper limit of the holding time is preferably shorter than 30 minutes or shorter than 20 minutes.

The above-described steel sheet for hot stamping according to the present embodiment can also be represented as follows.

(Appendix 1)

A steel sheet for hot stamping including, as a chemical composition, by mass %:

C: more than 0.40% and 0.70% or less;

Si: less than 2.00%;

Mn: 0.01% or more and less than 0.50%;

P: 0.200% or less;

S: 0.0200% or less;

sol. Al: 0.001% to 1.000%;

N: 0.0200% or less;

Mo: 0.01% or more and less than 0.50%;

B: 0.0002% to 0.0200%; and a remainder: Fe and impurities, wherein, when a Mo content of the steel sheet is measured by line analysis using an electron probe micro-analyzer (EPMA) in a range of 0.05 mm in a sheet thickness direction, in which a ¼ depth position of a sheet thickness of the steel sheet from a surface of the steel sheet is a center, a maximum value of the Mo content, a minimum value of the Mo content, and an average value of the Mo content satisfy Expression (i), and a standard deviation of a Vickers hardness in a region of 0.3 mm in the sheet thickness direction and 0.6 mm in a direction perpendicular to the sheet thickness direction, in which the ¼ depth position of the sheet thickness of the steel sheet from the surface of the steel sheet is a center, is 20 (Hv) or less, $$([Mo]_{MAX} - [Mo]_{MIN})/[Mo]_{AVE} < 0.50 \quad \text{(i)}$$

wherein meaning of each symbol in Expression (i) is as follows, $[Mo]_{MAX}$: the maximum value of the Mo content (mass %), $[Mo]_{MIN}$: the minimum value of the Mo content (mass %), and $[Mo]_{AVE}$: the average value of the Mo content (mass %).

(Appendix 2)

A steel sheet for hot stamping including, as a chemical composition, by mass %:

C: more than 0.40% and 0.70% or less;

Si: less than 2.00%;
Mn: 0.01% or more and less than 0.50%;
P: 0.200% or less;
S: 0.0200% or less;
sol. Al: 0.001% to 1.000%;
N: 0.0200% or less;
Mo: 0.01% or more and less than 0.50%;
B: 0.0002% to 0.0200%;
one or two or more selected from the group consisting of an A group, a B group, a C group, and a D group as follows; and
a remainder: Fe and impurities,
wherein, when a Mo content of the steel sheet is measured by line analysis using an electron probe micro-analyzer (EPMA) in a range of 0.05 mm in a sheet thickness direction, in which a ¼ depth position of a sheet thickness of the steel sheet from a surface of the steel sheet is a center, a maximum value of the Mo content, a minimum value of the Mo content, and an average value of the Mo content satisfy Expression (i), and
a standard deviation of a Vickers hardness in a region of 0.3 mm in the sheet thickness direction and 0.6 mm in a direction perpendicular to the sheet thickness direction, in which the ¼ depth position of the sheet thickness of the steel sheet from the surface of the steel sheet is a center, is 20 (Hv) or less,
[A group] one or two or more selected from the group consisting of Ti: 0.001% to 0.200% of Ti, Nb: 0.001% to 0.200%, V: 0.001% to 0.200%, and Zr: 0.001% to 0.200%,
[B group] one or two or more selected from the group consisting of Cr: 0.001% to 2.00%, W: 0.001% to 2.00%, Cu: 0.001% to 2.00%, and Ni: 0.001% to 2.00%,
[C group] one or two or more selected from the group consisting of Ca: 0.0001% to 0.0100%, Mg: 0.0001% to 0.0100%, and REM: 0.0001% to 0.1000%, and
[D group] Bi: 0.0001% to 0.0500%.

(Appendix 3)
The steel sheet for hot stamping according to (Appendix 2) including, as the chemical composition, by mass %, the A group.

(Appendix 4)
The steel sheet for hot stamping according to (Appendix 2) including, as the chemical composition, by mass %, the B group.

(Appendix 5)
The steel sheet for hot stamping according to (Appendix 2) including, as the chemical composition, by mass %, the C group.

(Appendix 6)
The steel sheet for hot stamping according to (Appendix 2) including, as the chemical composition, by mass %, the D group.

Hereinafter, the present invention will be described more specifically with reference to examples, but the present invention is not limited the examples.

EXAMPLES

Molten steel was cast using a vacuum melting furnace to manufacture Steels A to U having the chemical composition shown in Table 1. The $Ac_3$ point in Table 1 was obtained from changes in thermal expansion when cold-rolled steel sheets of Steels A to U were heated at 8° C./sec. Steels A to U were heated to 1,200° C. and held for 60 minutes, and then subjected to hot rolling under the hot rolling conditions shown in Table 2.

TABLE 1

| | Chemical composition (mass %) (remainder: Fe and impurities) | | | | | | | | | | | | | $Ac_3$ point |
|---|---|---|---|---|---|---|---|---|---|---|---|---|---|---|
| Steel | C | Si | Mn | P | S | sol. Al | N | Mo | B | Cr | Ti | Nb | Others | (° C.) |
| A | 0.43 | 0.39 | 0.39 | 0.011 | 0.0003 | 0.027 | 0.0019 | 0.20 | 0.0020 | — | 0.021 | 0.049 | — | 815 |
| B | 0.47 | 0.42 | 0.38 | 0.010 | 0.0017 | 0.049 | 0.0029 | 0.20 | 0.0018 | — | 0.020 | 0.051 | — | 813 |
| C | 0.46 | 0.004 | 0.48 | 0.010 | 0.0010 | 0.034 | 0.0022 | 0.05 | 0.0019 | 0.15 | 0.029 | 0.078 | — | 799 |
| D | 0.38 | 0.005 | 0.40 | 0.008 | 0.0004 | 0.045 | 0.0011 | 0.30 | 0.0018 | — | 0.020 | 0.050 | — | 811 |
| E | 0.72 | 0.005 | 0.45 | 0.008 | 0.0007 | 0.043 | 0.0018 | 0.05 | 0.0020 | — | — | — | — | 753 |
| F | 0.45 | 0.004 | 0.54 | 0.010 | 0.0018 | 0.045 | 0.0039 | 0.20 | 0.0018 | 0.62 | 0.020 | 0.047 | — | 790 |
| G | 0.51 | 0.38 | 0.29 | 0.008 | 0.0002 | 0.048 | 0.0021 | 0.20 | 0.0018 | 0.10 | 0.021 | — | — | 816 |
| H | 0.43 | 0.004 | 0.09 | 0.012 | 0.0003 | 0.055 | 0.0011 | 0.51 | 0.0018 | — | 0.021 | 0.049 | — | 819 |
| I | 0.43 | 0.03 | 0.38 | 0.011 | 0.0007 | 0.050 | 0.0019 | — | — | — | 0.020 | 0.050 | — | 811 |
| J | 0.44 | 0.03 | 0.39 | 0.010 | 0.0005 | 0.043 | 0.0025 | — | 0.0019 | 0.20 | 0.021 | 0.052 | — | 806 |
| K | 0.46 | 0.40 | 0.39 | 0.009 | 0.0006 | 0.047 | 0.0029 | 0.19 | 0.0018 | 0.33 | 0.021 | 0.019 | — | 808 |
| L | 0.46 | 0.60 | 0.39 | 0.010 | 0.0005 | 0.047 | 0.0034 | 0.19 | 0.0022 | 0.21 | 0.020 | 0.018 | — | 829 |
| M | 0.46 | 0.43 | 0.38 | 0.008 | 0.0008 | 0.049 | 0.0031 | 0.10 | 0.0018 | 0.33 | 0.021 | 0.019 | — | 806 |
| N | 0.46 | 0.42 | 0.39 | 0.010 | 0.0018 | 0.050 | 0.0031 | 0.19 | 0.0017 | — | 0.020 | — | — | 814 |
| O | 0.46 | 0.42 | 0.39 | 0.009 | 0.0017 | 0.048 | 0.0029 | 0.20 | 0.0018 | — | — | — | — | 804 |
| P | 0.46 | 0.40 | 0.39 | 0.008 | 0.0004 | 0.038 | 0.0020 | 0.19 | 0.0024 | — | — | — | V: 0:041<br>Zr: 0.017 | 798 |
| Q | 0.46 | 0.41 | 0.38 | 0.008 | 0.0006 | 0.038 | 0.0019 | 0.20 | 0.0019 | — | 0.022 | 0.028 | Cu: 0:30<br>Ni: 0.14 | 805 |
| R | 0.47 | 0.38 | 0.28 | 0.010 | 0.0006 | 0.039 | 0.0027 | 0.20 | 0.0020 | 0.28 | 0.021 | 0.028 | Ca: 0.0004<br>Mg: 0.0004<br>REM: 0.0005 | 810 |
| S | 0.47 | 0.39 | 0.18 | 0.010 | 0.0005 | 0.038 | 0.0030 | 0.19 | 0.0021 | 0.29 | 0.022 | 0.027 | Bi: 0.0021 | 816 |
| T | 0.46 | 0.41 | 0.38 | 0.010 | 0.0005 | 0.046 | 0.0030 | 0.10 | 0.0019 | 0.31 | 0.022 | 0.018 | W: 0.11 | 805 |
| U | 0.53 | 0.49 | 0.28 | 0.008 | 0.0002 | 0.049 | 0.0020 | 0.22 | 0.0020 | 0.31 | 0.020 | — | — | 803 |

Note)
1. The symbol "—" indicates no addition.
2. The $Ac_3$ point was obtained from a change in thermal expansion when the cold-rolled steel sheet was heated at 8° C./sec.

TABLE 2

| | | Hot rolling conditions | | | | | | Cold rolling conditions | |
|---|---|---|---|---|---|---|---|---|---|
| | | | | First hot-rolled sheet annealing | | Second hot-rolled sheet annealing | | | |
| Test No. | Steel | Sheet thickness after rolling (mm) | Coiling temperature (° C.) | Soaking temperature (° C.) | Soaking time (hour) | Soaking temperature (° C.) | Soaking time (hour) | Sheet thickness after rolling (mm) | Cold rolling reduction (%) |
| 1 | A | 3.2 | 640 | 900 | 3 | 850 | 30 | 1.4 | 56 |
| 2 | A | 3.2 | 640 | 900 | 3 | 850 | 30 | 1.4 | 56 |
| 3 | A | 3.2 | 640 | 900 | 3 | 850 | 30 | — | — |
| 4 | A | 3.2 | 640 | 900 | 3 | — | — | 1.4 | 56 |
| 5 | A | 3.2 | 640 | — | — | 850 | 30 | 1.4 | 56 |
| 6 | B | 2.6 | 660 | 900 | 3 | 850 | 60 | 1.4 | 46 |
| 7 | B | 2.6 | 660 | 900 | 3 | 850 | 60 | 1.4 | 46 |
| 8 | B | 2.6 | 660 | 900 | 3 | 850 | 60 | — | — |
| 9 | B | 2.6 | 660 | 900 | 3 | — | — | 1.4 | 46 |
| 10 | B | 2.6 | 660 | — | — | 850 | 60 | 1.4 | 46 |
| 11 | C | 2.6 | 660 | 900 | 2 | 820 | 30 | 1.4 | 46 |
| 12 | C | 2.6 | 660 | 900 | 2 | 900 | 3600 | 1.4 | 46 |
| 13 | D | 2.6 | 640 | 900 | 6 | 850 | 30 | 1.4 | 46 |
| 14 | E | 2.2 | 660 | 900 | 6 | 780 | 60 | 1.4 | 36 |
| 15 | F | 2.6 | 640 | 900 | 6 | 820 | 60 | 1.4 | 46 |
| 16 | G | 2.6 | 660 | 900 | 6 | 850 | 30 | 1.4 | 46 |
| 17 | H | 2.6 | 640 | 850 | 2 | 850 | 30 | 1.4 | 46 |
| 18 | I | 2.6 | 640 | 900 | 6 | 850 | 30 | 1.4 | 46 |
| 19 | J | 2.6 | 640 | 900 | 6 | 850 | 30 | 1.4 | 46 |
| 20 | K | 2.6 | 660 | 900 | 6 | 850 | 30 | 1.4 | 46 |
| 21 | K | 2.6 | 660 | 900 | 6 | 900 | 3600 | 1.4 | 46 |
| 22 | L | 2.2 | 660 | 900 | 3 | 850 | 30 | 1.4 | 36 |
| 23 | L | 2.2 | 660 | 850 | 0.1 | 850 | 30 | 1.4 | 36 |
| 24 | M | 2.6 | 660 | 900 | 3 | 850 | 30 | 1.4 | 46 |
| 25 | M | 2.6 | 660 | 900 | 3 | 850 | 3600 | 1.4 | 46 |
| 26 | N | 2.6 | 660 | 900 | 6 | 850 | 30 | 1.4 | 46 |
| 27 | O | 2.6 | 660 | 900 | 2 | 820 | 30 | 1.4 | 46 |
| 28 | O | 2.6 | 660 | 900 | 2 | 900 | 300 | 1.4 | 46 |
| 29 | P | 2.6 | 660 | 900 | 6 | 820 | 30 | 1.4 | 46 |
| 30 | Q | 2.6 | 660 | 900 | 6 | 850 | 30 | 1.4 | 46 |
| 31 | R | 2.6 | 660 | 900 | 3 | 850 | 30 | 1.4 | 46 |
| 32 | S | 2.6 | 660 | 900 | 3 | 850 | 30 | 1.4 | 46 |
| 33 | T | 2.6 | 660 | 900 | 3 | 850 | 30 | 1.4 | 46 |
| 34 | U | 2.6 | 640 | 900 | 6 | 820 | 30 | 1.4 | 46 |

| | | Mo concentration distribution of | Mechanical properties of steel sheet for hot stamping | | |
|---|---|---|---|---|---|
| Test No. | Presence or absence of annealing after cold rolling | steel sheet for hot stamping Left side value of Expression (i) | Tensile strength (MPa) | Average value of Vickers hardness (Hv) | Standard deviation of Vickers hardness (Hv) |
| 1 | Absent | 0.36 | 1087 | 337 | 13 |
| 2 | Present | 0.35 | 934 | 290 | 39 |
| 3 | Absent | 0.34 | 858 | 267 | 21 |
| 4 | Absent | 0.36 | 1162 | 360 | 30 |
| 5 | Absent | 0.52 | 1055 | 329 | 12 |
| 6 | Absent | 0.38 | 1058 | 328 | 14 |
| 7 | Present | 0.38 | 949 | 296 | 43 |
| 8 | Absent | 0.36 | 882 | 276 | 22 |
| 9 | Absent | 0.38 | 1134 | 355 | 32 |
| 10 | Absent | 0.54 | 1027 | 320 | 14 |
| 11 | Absent | 0.22 | 1023 | 319 | 13 |
| 12 | Absent | 0.20 | 1116 | 345 | 24 |
| 13 | Absent | 0.39 | 945 | 292 | 13 |
| 14 | Absent | 0.20 | 1103 | 340 | 18 |
| 15 | Absent | 0.32 | 1062 | 329 | 14 |
| 16 | Absent | 0.33 | 1068 | 332 | 15 |
| 17 | Absent | 0.52 | 1060 | 328 | 14 |
| 18 | Absent | — | 1009 | 311 | 17 |
| 19 | Absent | — | 1028 | 318 | 15 |
| 20 | Absent | 0.29 | 1057 | 325 | 14 |
| 21 | Absent | 0.27 | 1145 | 353 | 31 |
| 22 | Absent | 0.37 | 1039 | 323 | 18 |
| 23 | Absent | 0.51 | 1022 | 315 | 16 |
| 24 | Absent | 0.25 | 1060 | 331 | 14 |
| 25 | Absent | 0.24 | 1122 | 348 | 28 |
| 26 | Absent | 0.30 | 1005 | 314 | 14 |
| 27 | Absent | 0.38 | 977 | 306 | 17 |

TABLE 2-continued

| | | | | | |
|---|---|---|---|---|---|
| 28 | Absent | 0.38 | 994 | 309 | 22 |
| 29 | Absent | 0.29 | 1033 | 320 | 16 |
| 30 | Absent | 0.29 | 1055 | 326 | 14 |
| 31 | Absent | 0.34 | 1062 | 330 | 15 |
| 32 | Absent | 0.31 | 1060 | 332 | 14 |
| 33 | Absent | 0.26 | 1052 | 327 | 13 |
| 34 | Absent | 0.35 | 1088 | 338 | 13 |

Note)
1. The column "Sheet thickness after cold rolling" in the field "Hot rolling conditions": indicates the sheet thickness of the hot-rolled steel sheet.
2. The column "First hot-rolled sheet annealing": the symbol "—" indicates that first hot-rolled sheet annealing was not performed.
3. The column "Second hot-rolled sheet annealing": the symbol "—"indicates that second hot-rolled sheet annealing was not performed.
4. The column "Sheet thickness after cold rolling" in the field "Cold rolling conditions": indicates the sheet thickness of the cold-rolled steel sheet. The symbol "—" indicates that cold rolling was not performed.
5. The column "Presence or absence of annealing after cold rolling": "Present" indicates that annealing was performed, and "Absent" indicates that annealing was not performed.
6. The column "Left side value of Expression (i)": the symbol "—" indicates that calculation was not possible.

Specifically, Steels A to U were rolled in 10 passes in a temperature range of the $Ar_3$ point or higher into hot-rolled steel sheets having a thickness of 2.2 to 3.2 mum. After the hot rolling, the hot-rolled steel sheet was cooled to 640° C. to 660° C. with a water spray, a cooling finishing temperature was set to a coiling temperature, the hot-rolled steel sheet was loaded into an electric heating furnace held at the coiling temperature and held for 60 minutes, the hot-rolled steel sheet was then subjected to furnace cooling to room temperature at an average cooling rate of 20° C./hr, and thereby slow cooling after coiling was simulated.

The hot-rolled steel sheet was pickled and then subjected to first hot-rolled sheet annealing under the conditions shown in Table 2. Specifically, heating was performed from room temperature to a soaking temperature using an electric heating furnace at a heating rate of 100° C./hour, and soaking was performed for 0.1 to 6 hours. Subsequently, the steel sheet was taken out of the heating furnace and subjected to air cooling to room temperature. An average cooling rate from the soaking temperature to 500° C. was 9 to 10° C./sec. For some of the hot-rolled steel sheets, the first hot-rolled sheet annealing was skipped.

The hot-rolled and annealed steel sheet or the hot-rolled steel sheet was pickled, and then subjected to second hot-rolled sheet annealing under the conditions shown in Table 2. Specifically, heating was performed to a soaking temperature using an electric heating furnace at an average heating rate from 500° C. to the soaking temperature of 2 to 5° C./sec and soaking was performed for 30 seconds to 1 hour. Subsequently, the steel sheet was taken out of the heating furnace and subjected to air cooling to room temperature. An average cooling rate from the soaking temperature to 500° C. was 7 to 10° C./sec. For some of the hot-rolled and annealed steel sheets, the second hot-rolled sheet annealing was skipped.

The hot-rolled and annealed steel sheet was pickled and then cold-rolled under the conditions shown in Table 2 to obtain a cold-rolled steel sheet having a thickness of 1.4 mm.

Some of the hot-rolled and annealed steel sheets were not cold-rolled and were mechanically ground to obtain ground sheets having a thickness of 1.4 mm.

In addition, some of the cold-rolled steel sheets were heated from room temperature to 780° C. at a heating rate of 10° C./sec using a continuous annealing simulator and soaked for 120 seconds. Subsequently, cooling to room temperature was performed at an average cooling rate of 15° C./sec to obtain an annealed steel sheet.

A test piece for EPMA measurement was collected from the cold-rolled steel sheets, the ground sheets, and the annealed steel sheets (these steel sheets are collectively referred to as a steel sheet for hot stamping) obtained as described above, a longitudinal section of the test piece parallel to the rolling direction of the steel sheet was polished, a Mo concentration distribution (maximum value, minimum value, and average value) was then measured by the above-described method at a ¼ depth position of a sheet thickness (¼ depth position) of the steel sheet from a surface of the steel sheet in a sheet thickness direction of the steel sheet, and a left side value of Expression (i) was obtained. Specifically, JXA-8530F manufactured by JEOL Ltd. was used for the EPMA measurement, and line analysis was performed in the sheet thickness direction at measurement intervals of 0.20 μm with an acceleration voltage of 15.0 kV and an irradiation current of $5.0\times10^{-8}$ A. The maximum value, the minimum value, and the average value of the Mo contents were obtained from a five-point moving average value of the obtained measurement data. Using these values, the left side value of Expression (i) was calculated.

Furthermore, a JIS No. 13B tensile test piece was collected from the steel sheet for hot stamping along a direction perpendicular to the rolling direction, and a tensile test was conducted at a tensile speed of 10 mm/min to obtain a tensile strength.

In addition, a test piece for hardness measurement was collected from the steel sheet for hot stamping, a longitudinal section of the test piece parallel to the rolling direction of the steel sheet was polished, Vickers hardnesses were then measured at the ¼ depth position of the steel sheet by the above-described method with a load of 0.49 N according to JIS Z 2244:2009, and an average value and a standard deviation of the Vickers hardness were obtained.

In addition, a test piece for structure observation was collected from the steel sheet for hot stamping, a longitudinal section of the test piece parallel to the rolling direction of the steel sheet was polished, and a metallographic microstructure at the ¼ depth position of the steel sheet was then observed by the above-described method. Table 2 shows examination results of the Mo concentration distribution of the steel sheet for hot stamping and examination results of mechanical properties of the steel sheet for hot stamping. In Table 2, underlined numerical values mean outside of the ranges of the present invention.

Figure 2:
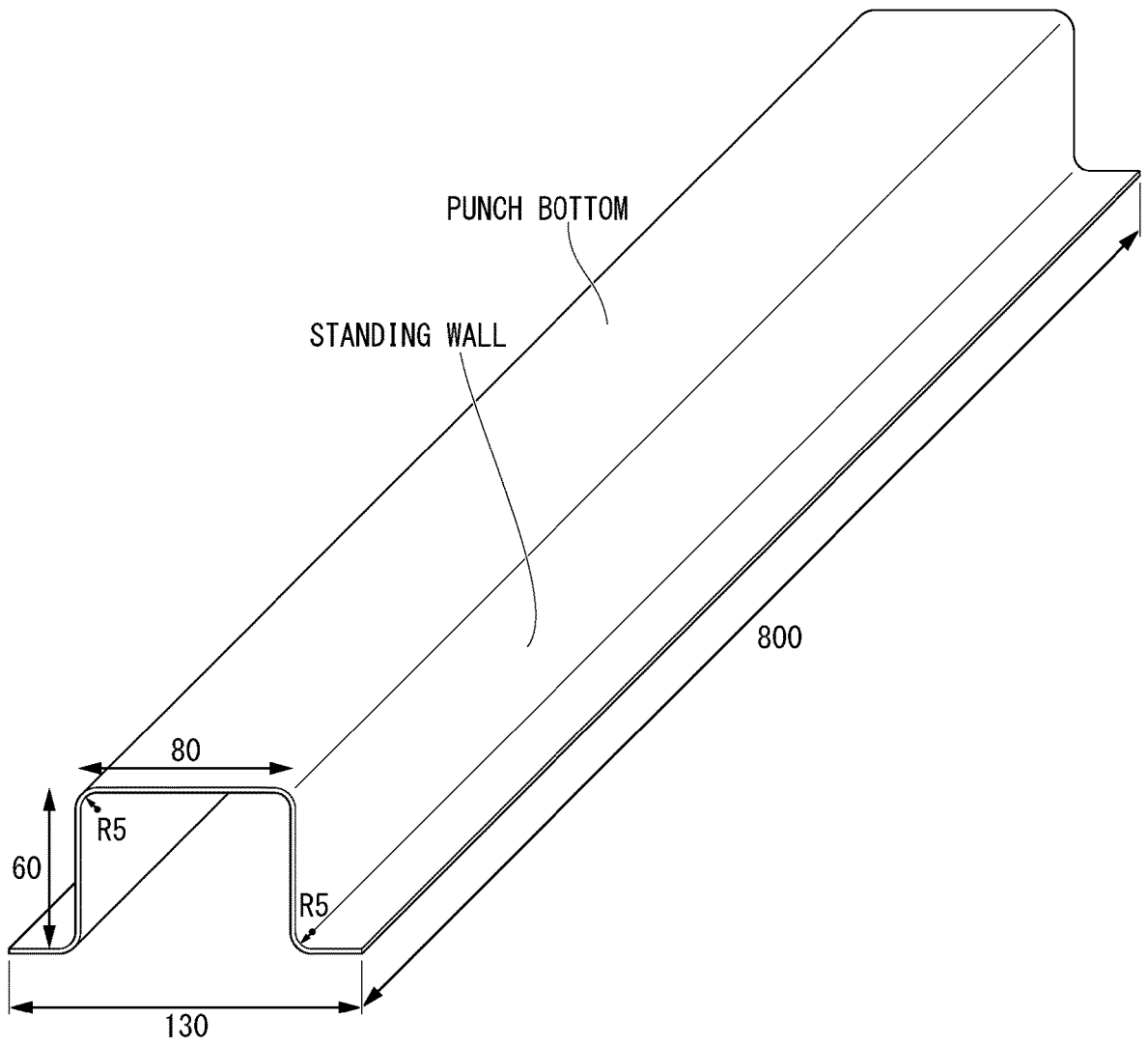
FIG. 2 is a schematic diagram showing an example of a shape of the hot stamped product.

An element sheet for hot stamping having a width of 240 mm and a length of 800 mm was collected from the steel sheet for hot stamping, and a hat member having the shape shown in FIG. 2 was manufactured by hot stamping. In a hot stamping step, a gas heating furnace was used to heat the element sheet (steel sheet for hot stamping) to 950° C. at an average heating rate up to 700° C. of 11° C./s, and held at the temperature for 1 minute. Thereafter, the element sheet was taken out of the heating furnace, was subjected to air cooling to 800° C., was sandwiched between dies provided with a cooling apparatus to form a hat, and was subsequently cooled to room temperature (25° C.) in the dies. In Test No. 34 using Steel U, the hat member after cooling was subjected to a reheating treatment of holding at 140° C. for 10 minutes using an electric heating furnace.

A test piece for structure observation was collected from a standing wall portion of the obtained hat member (hot stamped product), a longitudinal section of this test piece was polished, a metallographic microstructure was then observed at the ¼ depth position of the steel sheet by the above-described method, and volume percentages of martensite, retained austenite, and the others (one or more of ferrite, pearlite, bainite, and precipitates) were obtained.

In addition, a test piece for EPMA measurement was collected from the standing wall portion of the hat member (hot stamped product), a longitudinal section of the test piece was polished, a Mo concentration distribution was then measured at the ¼ depth position of the steel sheet by the above-described method, and a left side value of Expression (ii) was obtained.

Furthermore, a JIS No. 13B tensile test piece was collected from the standing wall portion of the hat member along a longitudinal direction of the member, and a tensile test was conducted at a tensile speed of 10 mm/min to obtain a tensile strength.

In addition, a test piece for hardness measurement was collected from the standing wall portion of the hat member, a longitudinal section of the test piece was polished, Vickers hardnesses were then measured at the ¼ depth position of the steel sheet by the above-described method with a load of 0.49 N according to JIS Z 2244:2009, and a standard deviation of the Vickers hardness was obtained.

Figure 3:
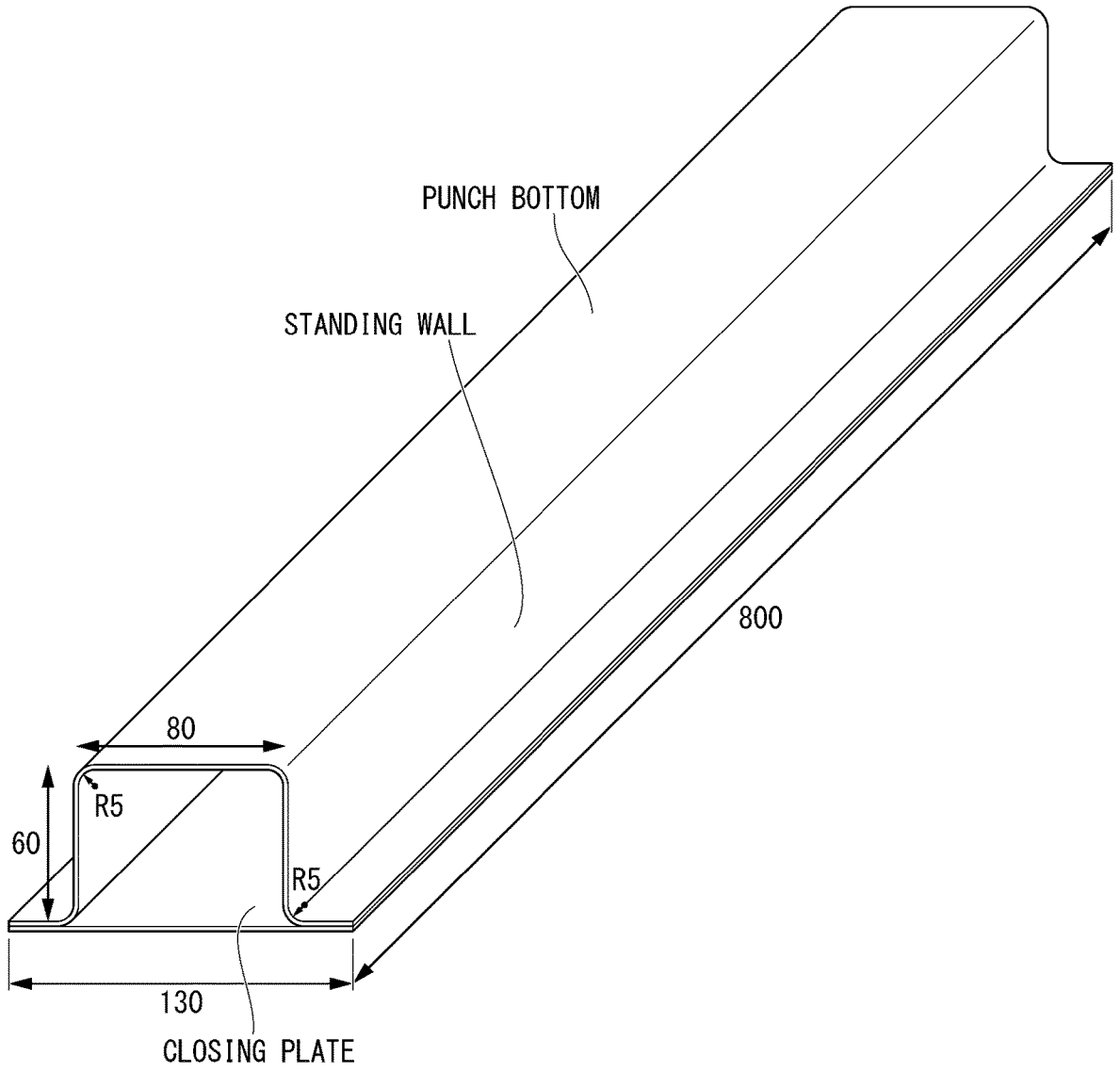
FIG. 3 is a schematic diagram showing a shape of a three-point bending test body.

In addition, as shown in FIG. 3, a closing plate having a thickness of 1.4 mm, a width of 130 mm, and a length of 800 mm was welded to the hat member to manufacture a test body for a three-point bending test. A steel sheet having a tensile strength of 1,553 MPa was used as the closing plate.

Figure 4:
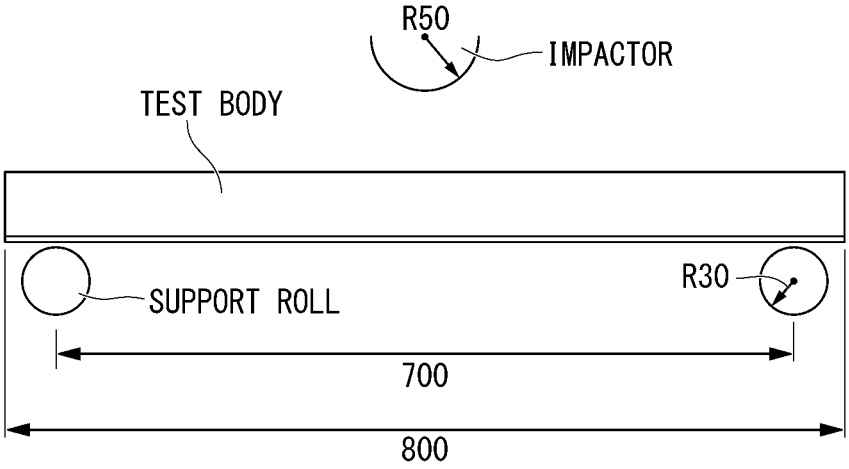
FIG. 4 is a schematic diagram showing an arrangement of a tester and a test body in a three-point bending test.

As shown in FIG. 4, the test body having a length of 800 mm was placed on two support rolls disposed at a roll interval of 700 mm so that the closing plate is a lower side, a three-point bending test was conducted at a test speed of 2 m/sec, and a maximum load, a displacement from a point of contact between the test body and an impactor until cracking began to occur in the test body, and an energy absorbed until cracking began to occur were obtained. When the maximum load was 23.0 kN or more, the cracking occurrence displacement was 35 mm or more, and the absorbed energy was 0.80 kJ or more, it was determined that the collision resistance was good.

Table 3 shows examination results of the Mo concentration distribution of the hat member, observation results of the metallographic microstructure of the hat member, evaluation results of the mechanical properties of the hat member, and evaluation results of the collision resistance of the hat member.

TABLE 3

| | | Mo concentration distribution of hot stamped product | Metallographic microstructure of hot stamped product | | | Mechanical properties of hot stamped product | | Collision resistance of hot stamped product | | |
|---|---|---|---|---|---|---|---|---|---|---|
| Test No. | Steel | Left side value of Expression (ii) | Volume percentage of martensite (%) | Volume percentage of retained austenite (%) | Volume percentage of the others (%) | Tensile strength (MPa) | Standard deviation of Vickers hardness (Hv) | Maximum load (kN) | Cracking occurrence displacement (mm) | Absorbed energy (kJ) |
| 1 | A | 0.35 | 95.9 | 3.1 | 1.0 | 2463 | 17 | 24.5 | 39 | 0.83 |
| 2 | A | 0.35 | 96.0 | 3.1 | 0.9 | 2458 | 27 | 24.3 | 26 | 0.54 |
| 3 | A | 0.34 | 96.1 | 2.9 | 1.0 | 2402 | 21 | 23.8 | 34 | 0.72 |
| 4 | A | 0.35 | 95.9 | 3.0 | 1.1 | 2460 | 24 | 24.3 | 30 | 0.63 |
| 5 | A | 0.51 | 96.0 | 2.7 | 1.3 | 2419 | 23 | 24.1 | 31 | 0.63 |
| 6 | B | 0.37 | 95.1 | 3.7 | 1.2 | 2717 | 18 | 26.1 | 35 | 0.85 |
| 7 | B | 0.38 | 95.2 | 3.8 | 1.0 | 2714 | 28 | 25.3 | 24 | 0.52 |
| 8 | B | 0.36 | 95.1 | 3.6 | 1.3 | 2665 | 22 | 25.7 | 31 | 0.70 |
| 9 | B | 0.37 | 95.1 | 3.6 | 1.3 | 2711 | 25 | 25.5 | 27 | 0.62 |
| 10 | B | 0.52 | 95.1 | 3.4 | 1.5 | 2682 | 23 | 25.3 | 29 | 0.63 |
| 11 | C | 0.22 | 95.0 | 3.2 | 1.7 | 2635 | 16 | 25.6 | 40 | 0.91 |
| 12 | C | 0.20 | 95.1 | 3.3 | 1.6 | 2626 | 22 | 25.1 | 33 | 0.73 |
| 13 | D | 0.37 | 96.1 | 2.2 | 1.7 | 2214 | 16 | 22.0 | 54 | 0.88 |
| 14 | E | 0.20 | 92.6 | 6.9 | 0.5 | — | 24 | 19.7 | 12 | 0.23 |
| 15 | F | 0.32 | 95.8 | 3.3 | 0.9 | 2543 | 21 | 22.9 | 20 | 0.35 |
| 16 | G | 0.32 | 93.9 | 4.4 | 1.7 | 2705 | 15 | 26.0 | 36 | 0.85 |
| 17 | H | 0.53 | 95.9 | 3.5 | 0.6 | 2485 | 25 | 24.1 | 25 | 0.50 |
| 18 | I | — | 59.0 | 2.5 | 38.5 | 1688 | 30 | 20.0 | 11 | 0.20 |
| 19 | J | — | 77.8 | 2.8 | 19.4 | 2229 | 27 | 20.4 | 10 | 0.19 |
| 20 | K | 0.29 | 95.7 | 3.8 | 0.5 | 2631 | 14 | 25.5 | 39 | 0.88 |
| 21 | K | 0.27 | 95.6 | 4.0 | 0.4 | 2619 | 24 | 25.0 | 30 | 0.64 |
| 22 | L | 0.36 | 94.9 | 4.3 | 0.6 | 2618 | 17 | 25.4 | 36 | 0.81 |
| 23 | L | 0.51 | 94.8 | 4.1 | 1.1 | 2607 | 23 | 25.3 | 30 | 0.65 |
| 24 | M | 0.25 | 95.8 | 3.3 | 0.9 | 2612 | 17 | 25.3 | 40 | 0.90 |
| 25 | M | 0.24 | 95.9 | 3.5 | 0.6 | 2604 | 25 | 25.2 | 30 | 0.68 |
| 26 | N | 0.30 | 95.9 | 3.6 | 0.5 | 2595 | 16 | 25.2 | 38 | 0.86 |
| 27 | O | 0.38 | 95.6 | 4.0 | 0.4 | 2633 | 17 | 25.6 | 37 | 0.83 |
| 28 | O | 0.37 | 95.5 | 4.0 | 0.5 | 2626 | 21 | 25.2 | 33 | 0.71 |
| 29 | P | 0.28 | 95.7 | 3.6 | 0.7 | 2620 | 17 | 25.2 | 38 | 0.85 |
| 30 | Q | 0.29 | 95.8 | 3.8 | 0.4 | 2637 | 18 | 25.7 | 39 | 0.87 |
| 31 | R | 0.33 | 96.1 | 3.2 | 0.7 | 2684 | 17 | 25.9 | 37 | 0.86 |
| 32 | S | 0.31 | 96.0 | 3.2 | 0.8 | 2691 | 18 | 25.8 | 37 | 0.86 |

TABLE 3-continued

| Test No. | Steel | Mo concentration distribution of hot stamped product: Left side value of Expression (ii) | Metallographic microstructure of hot stamped product: Volume percentage of martensite (%) | Volume percentage of retained austenite (%) | Volume percentage of the others (%) | Mechanical properties of hot stamped product: Tensile strength (MPa) | Standard deviation of Vickers hardness (Hv) | Collision resistance of hot stamped product: Maximum load (kN) | Cracking occurrence displacement (mm) | Absorbed energy (kJ) |
|---|---|---|---|---|---|---|---|---|---|---|
| 33 | T | 0.26 | 95.6 | 3.8 | 0.6 | 2622 | 16 | 25.4 | 40 | 0.89 |
| 34 | U | 0.34 | 94.1 | 4.6 | 1.3 | 2698 | 8 | 25.9 | 45 | 0.97 |

Note)
1. The column "Left side value of Expression (ii)": the symbol "—" indicates that calculation was not possible.
2. The column "Tensile strength" in the field "Mechanical properties of hot stamped product": the symbol "—" indicates that tensile strength could not be measured.
3. The column "Absorbed energy" in the field "Collision resistance of hot stamped product": indicates the energy absorbed until cracking began to occur.

In all of Test Nos. 1, 6, 11, 16, 20, 22, 24, 26, 27, and 29 to 34 that satisfy regulations of the present invention, in the steel sheet for hot stamping, the left side value of Expression (1) representing the Mo concentration distribution was less than 0.50, and the standard deviation of the Vickers hardness was 20 or less. In addition, in the three-point bending test of the hot stamped product, the maximum load was 23.0 kN or more, the cracking occurrence displacement was 35 mm or more, and the absorbed energy was 0.80 UC or more, so that good collision resistance was shown. In addition, although not shown in the table, the metallographic microstructure of the steel sheet for hot stamping according to the examples of the present invention contained more than 80.0 volume % of ferrite, pearlite, and/or bainite stretched in the rolling direction in total, and a remainder of one or more of martensite, retained austenite, and precipitates.

Contrary to this, in Test Nos. 2 to 5, 7 to 10, 12 to 15, and 17 to 19, 21, 23, 25, and 28 of Comparative Examples in which the chemical composition of the steel sheet for hot stamping, the Mo concentration distribution, or the standard deviation of the Vickers hardness was outside of the range of the present invention, in the three-point bending test of the hot stamped product, one or more of the maximum load, the cracking occurrence displacement, and the absorbed energy were low, and the collision resistance was inferior.

Specifically, in Test No. 13 using Steel D, the C content of the steel was too low, so that the tensile strength of the hot stamped product was less than 2,300 MPa, and the maximum load in the three-point bending test of the hot stamped product was low.

In Test No. 14 using Steel E, the C content of the steel was too high, so that fracture had occurred in an early stage in the tensile test of the hot stamped product, and the tensile strength could not be obtained. In addition, the standard deviation of the Vickers hardness of the hot stamped product was more than 20 (lv), and the maximum load, the cracking occurrence displacement, and the absorbed energy in the three-point bending test were low.

In Test No. 15 using Steel F, the Mn content of the steel was too high, so that the standard deviation of the Vickers hardness of the hot stamped product was more than 20 (Hv), and the maximum load, the cracking occurrence displacement, and the absorbed energy in the three-point bending test were low.

In Test No. 17 using Steel H, the Mo content of the steel was too high, so that the left side value of Expression (i) in the steel sheet for hot stamping was 0.50 or more, the left side value of Expression (ii) of the hot stamped product was 0.50 or more, the standard deviation of the Vickers hardness was more than 20 (Hv), and the cracking occurrence displacement and the absorbed energy in the three-point bending test were low.

In Test No. 18 using Steel I, the Mo content and the B content of the steel were too low, and in Test No. 19 using Steel J, the Mo content of the steel was too low, so that the volume percentage of martensite in the metallographic microstructure of the hot stamped product was insufficient, and the tensile strength of the formed product was less than 2,300 MPa. In addition, the standard deviation of the Vickers hardness of the hot stamped product was more than 20 (Hv), and the maximum load, the cracking occurrence displacement, and the absorbed energy in the three-point bending test were low.

In Test Nos. 2 to 5, 7 to 10, 12, 21, 23, 25, and 28 of Comparative Examples in which the chemical composition was within the ranges of the present invention but the manufacturing conditions of the hot stamped product were outside of the above ranges, the left side value of Expression (i) in the steel sheet for hot stamping was 0.50 or more, or the standard deviation of the Vickers hardness was more than 20 (Hv), the cracking occurrence displacement and the absorbed energy in the three-point bending test of the hot stamped product were low, and the collision resistance was inferior.

Specifically, in Test No. 2 using Steel A and Test No. 7 using Steel B, annealing was performed after the cold rolling in the manufacturing steps of the steel sheet for hot stamping (the steel sheet provided for hot stamping was not as cold-rolled), so that the standard deviation of the Vickers hardness in the steel sheet for hot stamping was more than 20 (Hv), the standard deviation of the Vickers hardness in the hot stamped product was also more than 20 (Hv), and the cracking occurrence displacement and the absorbed energy in the three-point bending test were low.

In Test No. 3 using Steel A and Test No. 8 using Steel B, cold rolling was not performed in the manufacturing steps of the steel sheet for hot stamping (the steel sheet provided for hot stamping was not as cold-rolled), so that the standard deviation of the Vickers hardness in the steel sheet for hot stamping was more than 20, the standard deviation of the Vickers hardness in the hot stamped product was also more than 20 (Hv), and the cracking occurrence displacement and the absorbed energy in the three-point bending test were low.

In Test No. 4 using Steel A and Test No. 9 using Steel B, the second hot-rolled sheet annealing was not performed in the manufacturing steps of the steel sheet for hot stamping, so that the standard deviation of the Vickers hardness in the steel sheet for hot stamping was more than 20 (Hv), the standard deviation of the Vickers hardness in the hot stamped product was also more than 20 (Hv), and the cracking occurrence displacement and the absorbed energy in the three-point bending test were low.

In Test No. 5 using Steel A and Test No. 10 using Steel B, the first hot-rolled sheet annealing was not performed in the manufacturing steps of the steel sheet for hot stamping, so that the left side value of Expression (i) in the steel sheet for hot stamping was 0.50 or more, the left side value of Expression (ii) of the hot stamped product was 0.50 or more, the standard deviation of the Vickers hardness was more than 20 (Hv), and the cracking occurrence displacement and the absorbed energy in the three-point bending test were low.

In Test No. 12 using Steel C and Test No. 21 using Steel K, the soaking temperature in the second hot-rolled sheet annealing was high and the soaking time was long in the manufacturing steps of the steel sheet for hot stamping, so that the standard deviation of the Vickers hardness in the steel sheet for hot stamping was more than 20 (Hv), the standard deviation of the Vickers hardness in the hot stamped product was also more than 20 (Hv), and the cracking occurrence displacement and the absorbed energy in the three-point bending test were low.

In Test No. 23 using Steel L, the soaking time of the first hot-rolled sheet annealing in the manufacturing steps of the steel sheet for hot stamping was short, so that the left side value of Expression (i) in the steel sheet for hot stamping was 0.50 or more, the left side value of Expression (ii) of the hot stamped product was 0.50 or more, the standard deviation of the Vickers hardness was more than 20 (Hv), and the cracking occurrence displacement and the absorbed energy in the three-point bending test were low.

In Test No. 25 using Steel M, the soaking time of the second hot-rolled sheet annealing in the manufacturing steps of the steel sheet for hot stamping was long, so that the standard deviation of the Vickers hardness in the steel sheet for hot stamping was more than 20 (Hv), the standard deviation of the Vickers hardness in the hot stamped product was also more than 20 (Hv), and the cracking occurrence displacement and the absorbed energy in the three-point bending test were low.

In Test No. 28 using Steel O, the soaking temperature of the second hot-rolled sheet annealing in the manufacturing steps of the steel sheet for hot stamping was high, so that the standard deviation of the Vickers hardness in the steel sheet for hot stamping was more than 20 (Hv), the standard deviation of the Vickers hardness in the hot stamped product was also more than 20 (Hv), and the cracking occurrence displacement and the absorbed energy in the three-point bending test were low.

INDUSTRIAL APPLICABILITY

According to the present invention, it is possible to obtain a steel sheet for hot stamping suitable as a material for a hot stamped product having excellent collision resistance and a tensile strength of 2,300 MPa or more.

By performing hot stamping using this steel sheet for hot stamping as a material, it is possible to manufacture a hot stamped product having a tensile strength of 2,300 MPa or more and excellent collision resistance.

What is claimed is:

1. A steel sheet for hot stamping comprising, as a chemical composition, by mass %:

C: more than 0.40% and 0.70% or less;
Si: less than 2.00%;
Mn: 0.01% or more and less than 0.50%;
P: 0.200% or less;
S: 0.0200% or less;
sol. Al: 0.001% to 1.000%;
N: 0.0200% or less;
Mo: 0.01% or more and less than 0.50%;
B: 0.0002% to 0.0200%;
Ti: 0% to 0.200%;
Nb: 0% to 0.200%;
V: 0% to 0.200%;
Zr: 0% to 0.200%;
Cr: 0% to 2.00%;
W: 0% to 2.00%;
Cu: 0% to 2.00%;
Ni: 0% to 2.00%;
Ca: 0% to 0.0100%;
Mg: 0% to 0.0100%;
REM: 0% to 0.1000%;
Bi: 0% to 0.0500%; and
a remainder: Fe and impurities, wherein, when a Mo content of the steel sheet is measured by line analysis using an electron probe micro-analyzer (EPMA) in a range of 0.05 mm in a sheet thickness direction, in which a ¼ depth position of a sheet thickness of the steel sheet from a surface of the steel sheet is a center, a maximum value of the Mo content, a minimum value of the Mo content, and an average value of the Mo content satisfy Expression (i), and a standard deviation of a Vickers hardness in a region of 0.3 mm in the sheet thickness direction and 0.6 mm in a direction perpendicular to the sheet thickness direction, in which the ¼ depth position of the sheet thickness of the steel sheet from the surface of the steel sheet is a center, is 20 (Hv) or less, $$([Mo]_{MAX} - [Mo]_{MIN})/[Mo]_{AVE} < 0.50 \quad \text{(i)}$$

wherein meaning of each symbol in Expression (i) is as follows, $[Mo]_{MAX}$: the maximum value of the Mo content (mass %), $[Mo]_{MIN}$: the minimum value of the Mo content (mass %), and $[MO]_{AVE}$: the average value of the Mo content (mass %).

2. The steel sheet for hot stamping according to claim 1, wherein the chemical composition contains, by mass %, one or more of:

Ti: 0.001% to 0.200%;
Nb: 0.001% to 0.200%;
V: 0.001% to 0.200%; and
Zr: 0.001% to 0.200%.

3. The steel sheet for hot stamping according to claim 1, wherein the chemical composition contains, by mass %, one or more of:

Cr: 0.001% to 2.00%;
W: 0.001% to 2.00%;
Cu: 0.001% to 2.00%; and
Ni: 0.001% to 2.00%.

4. The steel sheet for hot stamping according to claim 1, wherein the chemical composition contains, by mass %, one or more of Ca: 0.0001% to 0.0100%;
Mg: 0.0001% to 0.0100%; and
REM: 0.0001% to 0.1000%.

5. The steel sheet for hot stamping according to claim 1, wherein the chemical composition contains, by mass %:

Bi: 0.0001% to 0.0500%.

6. A hot stamped product comprising:

a base steel sheet, wherein the base steel sheet includes, as a chemical composition, by mass %, C: more than 0.40% and 0.70% or less, Si: less than 2.00%, Mn: 0.01% or more and less than 0.50%, P: 0.200% or less, S: 0.0200% or less, sol. Al: 0.001% to 1.000%, N: 0.0200% or less, Mo: 0.01% or more and less than 0.50%, B: 0.0002% to 0.0200%, Ti: 0% to 0.200%, Nb: 0% to 0.200%, V: 0% to 0.200%, Zr: 0% to 0.200%, Cr: 0% to 2.00%, W: 0% to 2.00%, Cu: 0% to 2.00%, Ni: 0% to 2.00%, Ca: 0% to 0.0100%, Mg: 0% to 0.0100%, REM: 0% to 0.1000%, Bi: 0% to 0.0500%, and a remainder: Fe and impurities, when a Mo content of the base steel sheet is measured by line analysis using an EPMA in a range of 0.05 mm in a sheet thickness direction, in which a ¼ depth position of a sheet thickness of the base steel sheet from a surface of the base steel sheet is a center, a maximum value of the Mo content, a minimum value of the Mo content, and an average value of the Mo content satisfy Expression (ii), a metallographic microstructure of the base steel sheet contains 90.0% or more of martensite, a standard deviation of a Vickers hardness in a region of 0.3 mm in the sheet thickness direction and 0.6 mm in a direction perpendicular to the sheet thickness direction, in which the ¼ depth position of the sheet thickness of the base steel sheet from the surface of the base steel sheet is a center, is 20 (Hv) or less, and a tensile strength of the base steel sheet is 2,300 MPa or more, $$([Mo]_{mMAX} - [Mo]_{mMIN})/[Mo]_{mAVE} < 0.50 \quad \text{(ii)}$$

wherein meaning of each symbol in Expression (ii) is as follows, $[Mo]_{mMAX}$: the maximum value of the Mo content of the base steel sheet (mass %), $[Mo]_{mMIN}$: the minimum value of the Mo content of the base steel sheet (mass %), and $[Mo]_{mAVE}$: the average value of the Mo content of the base steel sheet (mass %).

* * * * *